US008428855B2

(12) United States Patent
Okumoto et al.

(10) Patent No.: US 8,428,855 B2
(45) Date of Patent: Apr. 23, 2013

(54) SYSTEM FOR CONTROLLING STARTER FOR STARTING INTERNAL COMBUSTION ENGINE

(75) Inventors: Kazushige Okumoto, Kariya (JP); Akira Kato, Anjo (JP); Takashi Senda, Niwa-gun (JP)

(73) Assignee: Denso Corporation, Kariya (JP)

( * ) Notice: Subject to any disclaimer, the term of this patent is extended or adjusted under 35 U.S.C. 154(b) by 431 days.

(21) Appl. No.: 12/782,262

(22) Filed: May 18, 2010

(65) Prior Publication Data

US 2010/0299053 A1 Nov. 25, 2010

(30) Foreign Application Priority Data

May 21, 2009 (JP) ..... 2009-123207

(51) Int. Cl.
*F02N 11/08* (2006.01)

(52) U.S. Cl.
USPC ..... 701/113; 123/179.25; 123/179.28

(58) Field of Classification Search ..... 701/113; 123/179.28, 179.25
See application file for complete search history.

(56) References Cited

U.S. PATENT DOCUMENTS

| | | | | |
|---|---|---|---|---|
| 7,218,010 | B2 * | 5/2007 | Albertson et al. | 290/38 R |
| 8,079,340 | B2 * | 12/2011 | Okumoto et al. | 123/179.4 |
| 2008/0127927 | A1 | 6/2008 | Hirning et al. | |
| 2009/0020091 | A1 | 1/2009 | Botzenhard et al. | |
| 2010/0251852 | A1 * | 10/2010 | Murata et al. | 74/7 A |
| 2010/0282200 | A1 * | 11/2010 | Notani et al. | 123/179.3 |
| 2012/0104769 | A1 * | 5/2012 | Wanner | 290/38 C |

FOREIGN PATENT DOCUMENTS

| | | | |
|---|---|---|---|
| CN | 1760533 | A | 4/2006 |
| CN | 1821569 | A | 8/2006 |
| DE | 10 2009 002 721 | A1 * | 11/2010 |
| JP | A-2000-97139 | | 4/2000 |
| JP | A-2000-314364 | | 11/2000 |
| JP | A-2002-38984 | | 2/2002 |
| JP | A-2002-70699 | | 3/2002 |
| JP | A-2003-3938 | | 1/2003 |
| JP | A-2005-233081 | | 9/2005 |
| JP | A-2008-510099 | | 4/2008 |
| JP | A-2009-500550 | | 1/2009 |
| WO | WO 2007/101770 | A1 | 9/2007 |

OTHER PUBLICATIONS

Japanese Office Action issued in Japanese Patent Application No. 2009-123207 on Feb. 22, 2011 (with translation).

(Continued)

*Primary Examiner* — Hai Huynh
(74) *Attorney, Agent, or Firm* — Oliff & Berridge, PLC

(57) ABSTRACT

In a system for controlling a starter, the starter includes a pinion shiftable between an engagement position and a disengagement position. The starter includes an actuator configured to shift the pinion from the disengagement position to the engagement position when energized, and a motor configured to rotate the pinion when energized. The system includes a control circuit, a first switch unit configured to switch between energization and deenergization of the actuator under control of the control circuit, and a second switch unit configured to switch between energization and deenergization of the motor under control of the control circuit. The first switch unit and the second switch unit are individually arranged. The second switch unit includes a first relay configured to switch between energization and deenergization of the motor under control of the control circuit, and a second relay configured to control activation of the first relay.

18 Claims, 8 Drawing Sheets

OTHER PUBLICATIONS

Japanese Office Action issued in Japanese Patent Application No. 2009-123207 on Jul. 5, 2011 (with translation).

Mar. 28, 2012 Office Action issued in Chinese Patent Application No. 201010233575 (with translation).

* cited by examiner

SYSTEM FOR CONTROLLING STARTER FOR STARTING INTERNAL COMBUSTION ENGINE

CROSS REFERENCE TO RELATED APPLICATIONS

This application is based on Japanese Patent Application 2009-123207 filed on May 21, 2009. This application claims the benefit of priority from the Japanese Patent Application, so that the descriptions of which are all incorporated herein by reference.

FIELD OF THE INVENTION

The present invention relates to systems for controlling starters for starting internal combustion engines.

BACKGROUND OF THE INVENTION

Conventional starters for starting internal combustion engines normally include a pinion movable between an engagement position and a disengagement position. When the pinion is located at the engagement position, the pinion is engageable with a ring gear rotatable together with a crankshaft of an internal combustion engine. When the pinion is located at the disengagement position, the pinion is disengaged with the ring gear.

The conventional starters also include an actuator configured to shift the pinion from the engagement position to the disengagement position when energized. The conventional starters further include a motor for rotating the pinion when energized.

In view of improve, for example, drivability, control systems for controlling such a starter are required to restart, as immediately as possible, an internal combustion engine that has been stopped. Particularly, these requirements are increased when these control systems are installed in motor vehicles for automatically stopping their internal combustion engines during the motor vehicles being temporarily stopped.

In order to meet these requirements, control systems for these starters are designed to carry out so-called "preset control" or so-called "pre-rotation control" described hereinafter.

The "preset control" is proposed to mainly assume that an engine start request occurs during an internal combustion engine, referred to simply as "engine", being stopped. Specifically, the preset control is to shift the pinion to the engagement position prior to the occurrence of an engine start request, and to hold the pinion at the engagement position. Thereafter, when an engine start request occurs, the preset control is to rotate the pinion to thereby crank the engine. The preset control can start the engine more rapidly as compared to control to shift the pinion to the engagement position in response to the occurrence of an engine start request.

The "pre-rotation control" is proposed to mainly assume that an engine start request occurs during the rotational speed NE of the crankshaft of the engine being reduced. Specifically, the pre-rotation control is to rotate the pinion before the rotational speed NE reaches zero, and thereafter to shift the pinion to the engagement position so as to mesh the pinion with the turning ring gear. The pre-rotation control can start the engine more rapidly as compared to control to wait for the rotational speed NE to reach zero after the occurrence of an engine start request, and to engage the pinion with the ring gear.

In order to carry out the preset control and the pre-rotation control, control systems for starters are required to independently control shift of the pinion to the engagement position and rotation of the pinion.

In order to meet such requirements, US Patent Application Publication No. 2008/0127927 corresponding to WO Publication No. 2006/018350 and to Published Japanese translation No. 2008-51009 of the WO Publication No. 2006/018350 discloses a starter control system provided with a first MOS switch (first switch unit) for switching energization and deenergization of the actuator and with a second MOS switch (a second switch unit) for switching energization and deenergization of the motor. Similarly, WO Publication 2006/120180 corresponding to Published Japanese translation No. 2009-500550 thereof discloses the first and second MOS switches.

SUMMARY OF THE INVENTION

The inventors have discovered that there are problems in each of the starter control systems set forth above.

Specifically, because power to be supplied to the motor is higher than that to be supplied to the actuator, a MOS switch that withstands high current is required as the second MOS switch. For this reason, because a higher gate current is required to maintain the on state of the second MOS switch, an electronic control circuit, such as a microcomputer, cannot directly control the operations of the second MOS switch. This results in deteriorating the controllability of each of the starter control systems with respect to the second MOS switch.

Note that a mechanical solenoid switch can be used to energize and deenergize the motor in place of the second MOS switch. However, because a higher current to energize the mechanical solenoid switch is required to maintain the on state of the mechanical solenoid switch, this also results in deteriorating the controllability of each of the starter control systems with respect to the mechanical solenoid switch.

In view of the circumstances set force above, the present invention seeks to provide systems for controlling starters; these systems are designed to solve the problems caused in the conventional starter control systems set forth above.

Specifically, the present invention aims at providing systems for controlling starters each provided with an actuator and a motor, each of which is designed to improve the controllability with respect to a switch unit for energizing and deenergizing the motor.

According to one aspect of the present invention, there is provided a system for controlling a starter to start an internal combustion engine. The starter includes a pinion shiftable between an engagement position and a disengagement position. The pinion is engaged with a ring gear rotatable together with a crankshaft of the internal combustion engine when located at the engagement position. The pinion is disengaged with the ring gear when located at the disengagement position. The starter includes an actuator configured to shift the pinion from the disengagement position to the engagement position when energized, and a motor configured to rotate the pinion when energized. The system includes a control circuit, a first switch unit configured to switch between energization and deenergization of the actuator under control of the control circuit, and a second switch unit configured to switch between energization and deenergization of the motor under control of the control circuit. The first switch unit and the second switch unit are individually arranged. The second switch unit includes a first relay configured to switch between energization and deenergization of the motor under control of the control circuit, and a second relay configured to control activation of the first relay.

According to the one aspect of the present invention, the second switch unit is comprised of two-stage relays (first and second relays). That is, because the second relay mainly controls activation of the first relay, it is unnecessary to supply high power to the second relay in order to maintain the second relay in on state. Thus, the control circuit, such as an electronic control unit including a microcomputer, can directly control activation of the second relay, making it possible to improve the controllability of the system with respect to the second switch unit.

BRIEF DESCRIPTION OF THE DRAWINGS

Other objects and aspects of the invention will become apparent from the following description of embodiments with reference to the accompanying drawings in which.

DETAILED DESCRIPTION OF EMBODIMENTS OF THE INVENTION

Figure 1:
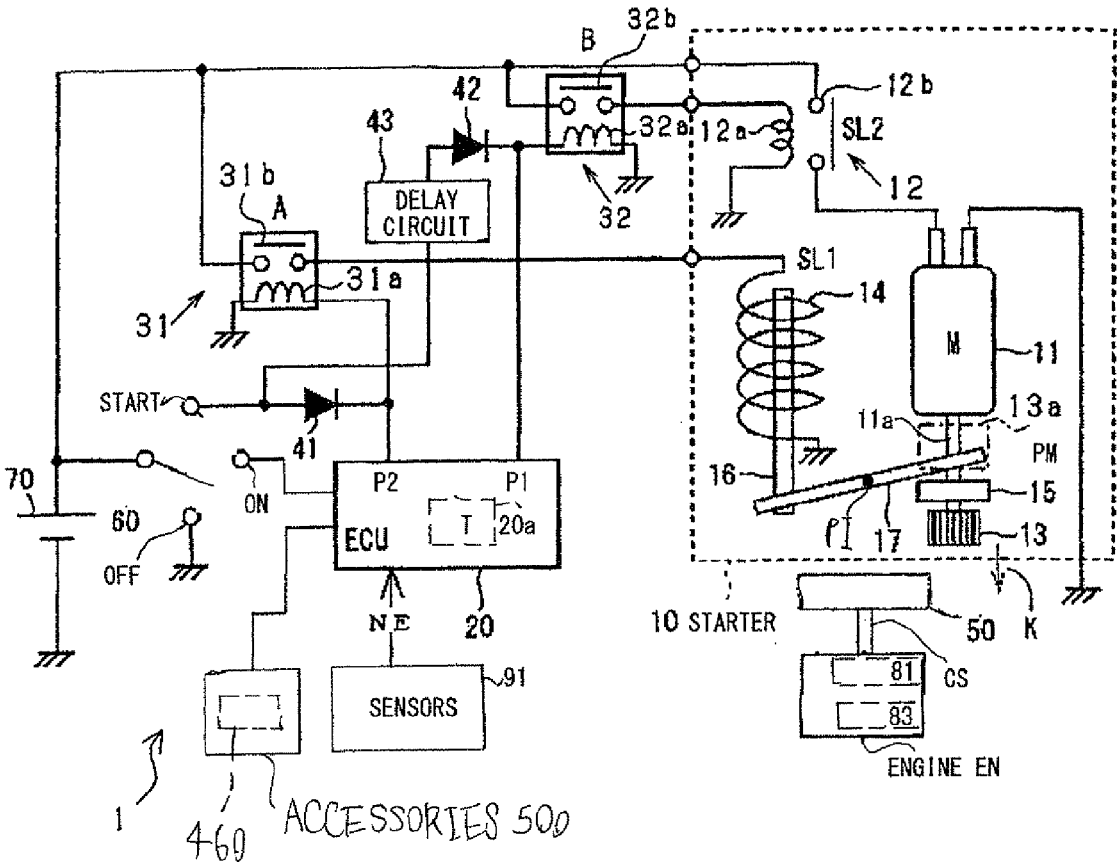
FIG. 1 is a schematic system configuration diagram of an engine starting system according to the first embodiment of the present invention.

Embodiments of the present invention will be described hereinafter with reference to the accompanying drawings.

In the embodiments, like parts between the embodiments, to which like reference characters are assigned, are omitted or simplified in redundant description.

First Embodiment

Referring to FIGS. 1 and 2, an engine starting system 1 according to the first embodiment of the present invention is installed in a motor vehicle. The engine starting system serves as an idle reduction system for automatically controlling the stop and restart of an internal combustion engine (referred to simply as "engine") EN installed in the motor vehicle.

The engine starting system 1 is comprised of a starter 10 used to start the engine EN, and an electronic control unit (ECU) 20 for control of operations of the starter 1 at the start of the engine EN. The engine starting system 1 also includes a first drive relay 31, a second drive relay 32, a first diode 41, a second diode 42, a delay circuit 43, and a battery 70.

Referring to FIG. 1, the engine EN has a crankshaft CS, as an output shaft thereof, with one end to which a ring gear 50 is directly or indirectly coupled.

The engine EN works to compress air-fuel mixture or air by a moving piston within each cylinder, and burn the compressed air-fuel mixture or the mixture of the compressed air and fuel within each cylinder to change the fuel energy to mechanical energy, such as rotative energy, thus rotating the crankshaft CS. The rotation of the crankshaft CS is transferred to driving wheels through a powertrain installed in the motor vehicle to thereby drive the motor vehicle. Oil (engine oil) is within each cylinder to lubricate any two parts placed in the engine EN to be in contact with each other, such as the moving piston and each cylinder.

The engine EN is installed with, for example, an ignition system 81 and a fuel injection system 83.

The ignition system 81 includes actuators, such as igniters, AC and causes the actuators AC to provide an electric current or spark to ignite an air-fuel mixture in each cylinder of the engine EN, thus burning the air-fuel mixture.

The fuel injection system 83 includes actuators, such as fuel injectors, AC and causes the actuators AC to spray fuel either directly into each cylinder of the engine EN or into an intake manifold (or intake port) just ahead of each cylinder thereof to thereby burn the air-fuel mixture in each cylinder of the engine EN. When the internal combustion engine is designed as a diesel engine, the ignition system 81 can be eliminated.

In addition, in the motor vehicle, for measuring the operating conditions of the engine EN and the driving conditions of the motor vehicle, sensors 91 are installed in the motor vehicle.

Each of the sensors 91 is operative to measure an instant value of a corresponding one parameter associated with the operating conditions of the engine EN and/or the motor vehicle and to output, to the ECU 20, a signal indicative of the measured value of a corresponding one parameter.

Specifically, the sensors 91 include, for example, a rotational speed sensor, an accelerator sensor (throttle position sensor), and a brake sensor; these sensors are electrically connected to the ECU 20.

The rotational speed sensor is operative to output, to the ECU 20, a signal indicative of a rotational speed (the number of revolutions per unit of time) NE of the crankshaft CS of the engine EN.

The accelerator sensor is operative to:

measure an actual position or stroke of a driver-operable accelerator pedal of the motor vehicle linked to a throttle valve for controlling the amount of air entering the intake manifold; and output a signal indicative of the measured actual stroke or position of the accelerator pedal to the ECU 20.

The brake sensor is operative to measure an actual position or stroke of a brake pedal of the motor vehicle operable by the driver and to output a signal indicative of the measured actual stroke or position of the brake pedal.

The starter 10 is comprised of a starter motor (motor) 11, an output shaft 11*a*, a relay switch (first relay) 12, a movable pinion member PM, a solenoid 14, a plunger 16, and a shift lever 17. For example, the solenoid 14, the plunger 16, and the shift lever 17 constitute a pinion-shifting actuator.

The motor 11 is made up of a motor output shaft (not shown) coupled to one end of the output shaft 11*a* via a reduction mechanism and an armature coupled to the motor output shaft and electrically connected to the relay switch 12. The relay switch 12 is comprised of a solenoid 12*a* and a switch 12*b*. The switch 12*b* is electrically connected between a positive terminal of the battery 70 whose negative terminal is grounded and the armature of the motor 11. The voltage of the battery 70 (battery voltage) is set to, for example, 12 V.

The movable pinion member PM consists of a one-way clutch 15 and a pinion 13.

As illustrated in FIG. 1, the one-way clutch 15 is provided in helical spline engagement with an outer circumference of the other end of the output shaft 11*a*.

The one-way clutch 15 is comprised of a clutch outer coupled to the other end of the output shaft 11 a and a clutch inner on which the pinion 13 is mounted; these clutch inner and clutch outer are provided in helical spline engagement with each other.

The structure of the one-way clutch 15 allows the pinion 13 to be shiftable in the axial direction of the output shaft 11*a* together with the clutch inner of the one-way clutch 15 and rotatable therewith. Specifically, the engine EN and the starter 10 are arranged such that the pinion 13 (movable pinion member PM) is shiftable between an engagement position where the pinion 13 is engageable with the ring gear 50 and a disengagement position where the pinion 13 is disengaged therewith.

When energized, the motor 11 rotates the motor output shaft together with the output shaft 11*a*, thus rotating the pinion 13 (movable pinion member PM). Otherwise, when deenergized, the motor 11 stops rotation of the motor output shaft and the output shaft 11*a*, thus stopping rotation of the pinion 13 (movable pinion member PM).

The one-way clutch 15 is designed to transfer rotational motion supplied from the motor 11 to the clutch inner (pinion 13) without transferring rotational motion supplied from the clutch inner (pinion 13) to the clutch outer (motor 11).

The reduction mechanism is coaxially mounted on the one end of the output shaft 11*a* and located, for example, between the one-way clutch 15 and the motor 11. In order to simply illustrate the starter 10, the reduction mechanism is omitted in illustration. The reduction mechanism is designed to transfer the torque of the motor output shaft while reducing the rotational speed of the motor output shaft, thus increasing the torque that rotates the output shaft 11*a*.

The solenoid 14 is wound around the plunger 16 arranged to be shiftable in its length direction corresponding to the axial direction of the solenoid 14. One end of the plunger 16 is pivotally linked to one end of the shift lever 17, and the other end of the shift lever 17 is pivotally linked to the movable pinion member PM. The shift lever 17 is pivoted about a pivot PI located at its substantially center in the length direction.

One end of the solenoid 14 is electrically connected to the positive terminal of the battery 70 via the first drive relay 31, and the other end thereof is grounded.

In the first embodiment, the engine starting system 1 includes a shock absorber 13*a* mounted on the output shaft 11*a*. The shock absorber 13*a* is operative to reduce (absorb) torque to which the pinion 13 is subjected when the pinion 13 is meshed with the ring gear 50. This makes it possible to improve the reliability of the engine starting system 1.

Note that, in order to facilitate a better understanding of the descriptions of the operations of the engine starting system 1, the solenoid 14 is illustrated by character SL1, and the relay switch 12 is illustrated by character SL2.

The ECU 20 is designed as, for example, a normal microcomputer circuit consisting of, for example, a CPU, a storage medium 20*a* including a ROM (Read Only Memory), such as a rewritable ROM, a RAM (Random Access Memory), and the like, an IO (Input and output) interface, and so on.

The storage medium 20*a* stores therein beforehand various engine control programs.

The ECU 20 is provided at its IO with output ports P1 and P2 from which various control signals are outputted.

The ECU 20 is operative to:

receive the signals outputted from the sensors 91; and control, based on the operating conditions of the engine EN determined by at least some of the received signals from the sensors 91, various actuators AC installed in the engine EN to thereby adjust various controlled variables of the engine EN.

For example, the ECU 20 is programmed to:

adjust a quantity of intake air into each cylinder;

compute a proper ignition timing for the igniter AC for each cylinder, and a proper fuel injection timing and a proper injection quantity for the fuel injector AC for each cylinder;

instruct the fuel injector AC for each cylinder to spray, at a corresponding computed proper injection timing, a corresponding computed proper quantity of fuel into each cylinder; and instruct the igniter AC for each cylinder to ignite the compressed air-fuel mixture or the mixture of the compressed air and fuel in each cylinder at a corresponding computed proper ignition timing.

The first drive relay 31 serves as a first switch unit for energizing and deenergizing the solenoid 14. Specifically, the first drive relay 31 is comprised of, for example, a solenoid 31*a* and a switch 31*b*. One end of the solenoid 31*a* is electrically connected to the output port P2 of the ECU 20 and to an ignition key switch 60 through the first diode 41, and the other end is grounded. The ignition key switch 60 is provided in the motor vehicle, and is comprised of a driver operable ignition key, an ignition-ON contact (position) ON electrically connected to the ECU 20, a starter-ON contact (position) START electrically connected to the first diode D1, and an OFF contact (position) OFF that is grounded.

The ignition key switch 60 is electrically connected to the positive terminal of the battery 70.

When an energizing current is supplied from the ECU 20 to the solenoid 31 a via the output port P2, the solenoid 31 a is energized.

The switch 31*b* is electrically connected between the positive terminal of the battery 70 and the one end of the solenoid 14. The switch 31*b* is turned on (closed) by magnetic force generated when the solenoid 31*a* is energized so that the solenoid 14 is energized.

When energized, the solenoid 14 shifts the plunger 16 to be pulled thereinto against the force of a return spring (not shown). The pull-in shift of the plunger 16 allows the shift lever 17 to be pivoted so that the movable pinion member PM is shifted to the engagement position; this shift of the pinion movable member PM (pinion 13) is illustrated by arrow K. This allows the pinion 13 to be meshed with the ring gear 50 for cranking the engine EN.

Otherwise, when no energizing current is sent from the ECU 20 to the solenoid 31*a* via the output port P2, the solenoid 31*a* is deenergized so that the switch 31*b* is turned off, resulting in that the solenoid 14 is deenergized.

When deenergized, the return spring returns the plunger 16 to its original position illustrated in FIG. 1 so that the pinion 13 is out of mesh with the ring gear 50, resulting in that the pinion 13 is located to the disengagement position.

The second drive relay 32 is comprised of, for example, a solenoid 32*a* and a switch 32*b*.

One end of the solenoid 32*a* is electrically connected to an output port P1 of the ECU 20 and to the starter-ON position START of the ignition switch 60 through the delay circuit 43 and the second diode 42, and the other end is grounded.

When an energizing current is supplied from the ECU 20 to the solenoid 32*a* via the output port P1, the solenoid 32*a* is energized. The switch 32*b* is electrically connected between the positive terminal of the battery 70 and the solenoid 12*a* of the relay switch 12. The switch 32*b* is turned on (closed) by magnetic force generated when the solenoid 32*a* is energized so that the solenoid 12*a* is energized.

When the solenoid 12*a* is energized, the switch 12*b* is closed (turned on) so that the armature of the motor 11 is energized. This causes the motor 11 to rotate the motor output shaft together with the output shaft 11*a*, thus rotating the pinion 13 (movable pinion member PM).

Otherwise, when no energizing current is sent from the ECU 20 to the solenoid 32*a* via the output port P1, the solenoid 32*a* is deenergized so that the switch 32*b* is turned off, resulting in that the solenoid 12*a* is deenergized.

When the solenoid 12*a* is deenergized, the switch 12*b* is opened (turned off) so that the armature of the motor 11 is deenergized. This causes the motor 11 to stop the rotation of the motor output shaft and the output shaft 11*a*, thus stopping the rotation of the pinion 13 (movable pinion member PM).

In addition, when the ignition key is inserted by the driver in a key cylinder of the motor vehicle and operated by the driver to the ignition-ON position ON from the OFF position, electric power of the battery 70 is supplied to the ECU 20 so that the ECU 20 is activated. The ECU 20 converts the battery voltage, such as 12 V applied from the battery 70 to an operating voltage of, for example, 5 V, and operates on the operating voltage.

When the ignition key inserted in the key cylinder is turned by the driver from the ignition-ON position ON to the starter-ON position START, an energizing current is supplied from the battery 70 to the solenoid 31*a* via the first diode 41 and to the solenoid 32*b* via the delay circuit 43 and the second diode 42.

Because the delay circuit 43 located between the ignition key switch 60 and the second drive relay 32, the energizing current supplied from the battery 70 is delayed by the delay circuit 43 by a preset delay time, and thereafter, the energizing current is supplied to the solenoid 32*a*.

The preset delay time is deter mined as a period required from the start of shifting of the pinion 13 to the engagement position to engagement of the pinion 13 to the ring gear 50.

That is, energization of the solenoid 31*a* in response to the driver's operation of the ignition key switch 60 is made earlier than energization of the solenoid 32*a* in response to the driver's operation of the ignition key switch 60.

Thus, the switch 31*b* is turned on (closed) by magnetic force generated when the solenoid 31*a* is energized so that the solenoid 14 is energized. As described above, the energization of the solenoid 14 shifts the pinion 13 to the engagement position, resulting in that the pinion 13 is meshed with the ring gear 50.

Because the preset delay time is determined as the period required from the start of shifting of the pinion 13 to the engagement position to engagement of the pinion 13 to the ring gear 50, after the engagement of the pinion 13 with the ring gear 50, the switch 32*b* is turned on (closed) by magnetic force generated when the solenoid 32*a* is energized so that the solenoid 12*a* is energized.

When the solenoid 12*a* is energized, the switch 12*b* is closed (turned on) so that the armature of the motor 11 is energized. As described above, energization of the motor 11 rotates the pinion 13 (movable pinion member PM). Because the pinion 13 is meshed with the ring gear 50, the rotation of the pinion 13 cranks the engine EN.

Otherwise, while the ignition switch 60 is not located at the starter-ON position START, each of the first and second drive relays 31 and 32 is in off state so that each of the solenoids 14 and 12*a* is deenergized.

The engine control programs stored in the storage medium 20*a* include an engine stop-and-start control routine (program). The ECU 20 repeatedly runs the engine stop-and-start control routine in a given cycle during its being energized.

Specifically, in accordance with the engine automatic stop-and start control routine, the ECU 20 repetitively determines whether at least one of predetermined engine automatic stop conditions is met based on the signals outputted from the sensors 91. In other words, the ECU 20 repetitively determines whether an engine automatic stop request occurs based on the signals outputted from the sensors 91.

Upon determining that at least one of the predetermined engine automatic stop conditions is met (an engine automatic stop request occurs), the ECU 20 carries out an engine automatic stop task. The engine automatic stop task is, for example, to shut off the fuel injection into each cylinder of the engine EN.

The predetermined engine automatic stop conditions include, for example, the following conditions that:

the stroke of the driver's accelerator pedal is zero (the driver completely releases the accelerator pedal) so that the throttle valve is positioned in its idle speed position;

the driver depresses the brake pedal when the vehicle speed is zero; and the engine speed is equal to or lower than a preset speed (idle-reduction execution speed).

After the automatic stop of the engine EN, in accordance with a starter-drive subroutine included in the engine automatic stop-and start control routine, the ECU 20 determines whether at least one of predetermined engine restart conditions is met based on the signals outputted from the sensors 91.

When determining that at least one of the predetermined engine restart conditions is met based on the signals outputted from the sensors 57, in other words, when determining that an engine start request occurs, the ECU 20 carries out an engine automatic start task T. The engine automatic start task T is to:

drive the starter 10 to crank the engine EN so that the crankshaft CS is turned at an initial speed (idle speed);

instruct the injector AC for each cylinder to restart spraying fuel into a corresponding cylinder; and instruct the igniter AC for each cylinder to restart igniting the air-fuel mixture in a corresponding cylinder.

The predetermined engine restart conditions include, for example, the following conditions that:

the accelerator pedal is depressed (the throttle valve is opened); and the stroke of the driver's brake pedal is zero (the driver completely releases the brake pedal.

Next, the engine automatic start task T to be carried by the ECU 20 will be described hereinafter. The ECU 20 runs the engine automatic start task T each time an engine start request occurs.

Figure 2A:
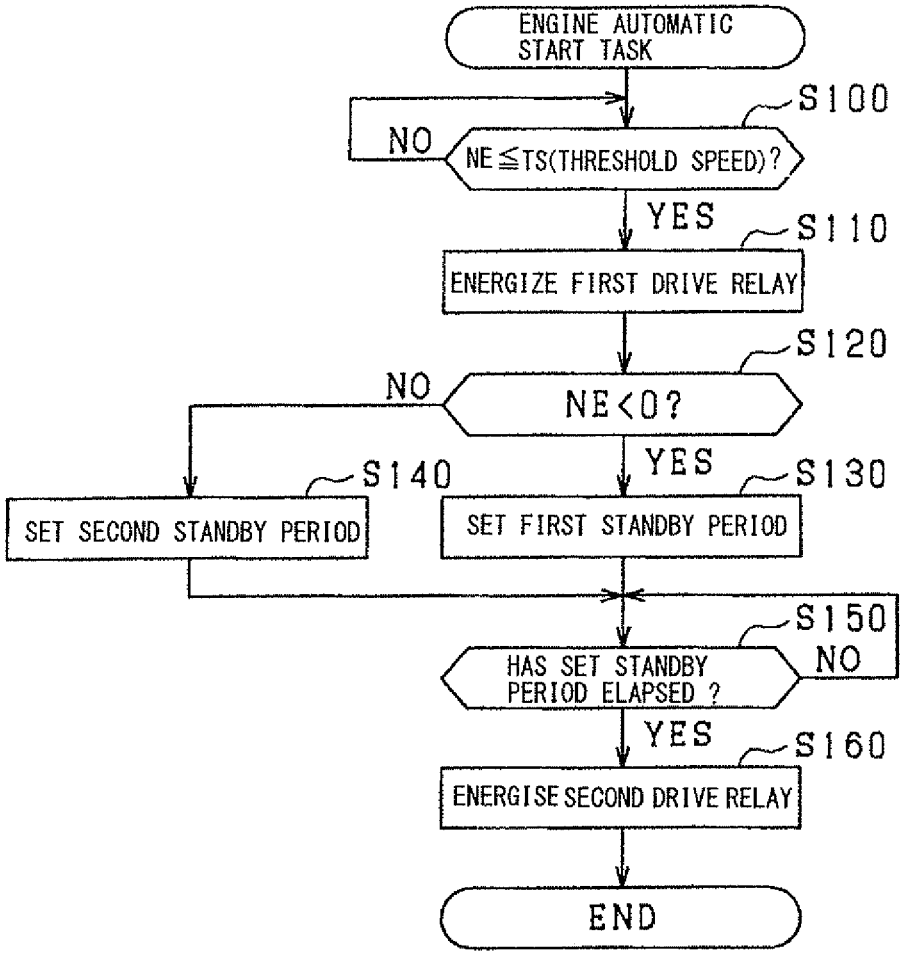
FIG. 2A is a flowchart schematically illustrating an engine automatic start task to be executed by the ECU according to the first embodiment.

In step S100 of FIG. 2A, the ECU 20 determines whether the rotational speed NE of the crankshaft CS of the engine EN in a forward direction at the time of the occurrence of an engine start request is equal to or lower than a preset threshold speed TS.

The preset threshold speed TS will be described hereinafter.

When the number of revolutions per unit of time of the pinion 13 and the number of revolutions per unit of time of the ring gear 50 are widely different from each other, engagement of the pinion 13 with the ring gear 50 cannot be carried out.

However, the rotational speed NE of the crankshaft CS of the engine EN becomes equal to or lower than a constant rotational speed (a constant number of revolutions per unit of time), the pinion 13 can be engaged with the ring gear 50 without rotation of the pinion 13. The constant rotational speed will be referred to as "preset threshold speed TS".

Specifically, when the rotational speed NE of the crankshaft CS of the engine EN becomes equal to or lower than the preset threshold speed TS, it is possible to engage the pinion 13 with the ring gear 50. The preset threshold speed TS is preferably set to be equal to or lower than the idle speed and equal to or higher than a local minimum value of the pulsating rotational speed NE of the crankshaft CS of the engine EN being cranked by the motor 11.

Upon determining that the rotational speed NE of the crankshaft CS of the engine EN is equal to or lower than the preset threshold speed TS (YES in step S100), the ECU 20 proceeds to step S110. Otherwise, upon determining that the rotational speed NE of the crankshaft CS of the engine EN is higher than the preset threshold speed TS (NO in step S100), the ECU 20 repeats the determination in step S100.

In step S110, the ECU 20 energizes the first drive relay 31. This energization of the first drive relay 31 energizes the solenoid 14 (SL1), thus shifting the pinion 13 to the engagement position.

In step S120, the ECU 20 determines whether the rotational speed NE of the crankshaft CS of the engine EN immediately after the energization of the first drive relay 31 is lower than zero. Upon determining that the rotational speed NE of the crankshaft CS of the engine EN is lower than zero (YES in step S120), the ECU 20 determines that the crankshaft CS of the engine EN is temporarily rotated in a reverse direction, and sets a first standby period P1 in step S130, proceeding to step S150.

Otherwise, upon determining that the rotational speed NE of the crankshaft CS of the engine EN is equal to or higher than zero (NO in step S120), the ECU 20 sets a second standby period P2 in step S140, proceeding to step S150. The second standby period P2 is required from the start of shifting of the pinion 13 to engagement of the pinion 13 with the ring gear 50. The first standby period P1 is set to be slightly higher than the second standby period P2.

In step S150, the ECU 20 determines whether the set standby period (the first standby period P1 or the second standby period P2) has elapsed since the start of shifting of the pinion 13.

Upon determining that the set standby period (the first standby period P1 or the second standby period P2) has not elapsed (NO in step S150), the ECU 20 repeats the determination in step S150.

Otherwise, upon determining that the set standby period (the first standby period P1 or the second standby period P2) has elapsed (YES in step S150), the ECU 20 energizes the second drive relay 32 to energize the motor 11, thus rotating the pinion 13 in step S160. Thereafter, the ECU 20 exits the engine automatic start task T.

Note that, as described above, when the ignition key inserted in the key cylinder is turned by the driver from the ignition-ON position ON to the starter-ON position START, the energizing current is supplied from the battery 70 to the solenoid 31*a* via the first diode 41 and to the solenoid 32*b* via the delay circuit 43 and the second diode 42.

That is, the energizing current supplied from the battery 70 is supplied to the solenoid 31*a* so that the first drive relay 31 is turned on, and after the preset delay time has elapsed since the turning on of the first drive relay 31, the energizing current is supplied to the solenoid 32*a* so that the second drive relay 32 is turned on.

Because the preset delay time is determined as the period required from the start of shifting of the pinion 13 to the engagement position to engagement of the pinion 13 to the ring gear 50, after the engagement of the pinion 13 with the ring gear 50, the second drive relay 32 is turned on so that the relay switch 12 is turned on, resulting in energizing the armature of the motor 11. This causes the motor 11 to rotate the pinion 13 (movable pinion member PM). Because the pinion 13 is meshed with the ring gear 50, the rotation of the pinion 13 cranks the engine EN.

As described above, even if an engine start request occurs with the rotational speed NE of the crankshaft CS of the engine EN being higher than the preset threshold speed, the engine automatic start task T is to wait for rotation of the pinion 13 (see step S100), and to turn on the first drive relay 31 to thereby shift the pinion 13 to the engagement position when the rotational speed NE of the crankshaft CS of the engine EN is equal to or lower than the preset threshold speed (see step S110). If an engine start request occurs with the rotational speed NE of the crankshaft CS of the engine EN being equal to or lower than the preset threshold speed, the engine automatic start task T is to immediately turn on the first drive relay 31 to thereby shift the pinion 13 to the engagement position.

Thereafter, when the pinion 13 is engaged with the ring gear 50 (YES in step S150), the engine automatic start task T is to turn on the second drive relay 32 to rotate the motor 11 and the pinion 13, thus cranking the engine EN (see step S160).

Specifically, when an engine restart request occurs during the rotational speed NE of the crankshaft CS dropping (coasting) after automatic stop of the engine EN, the engine starting system 1 controls the starter 10 to shift the pinion 13 to the engagement position without rotation in immediate response to the occurrence of the engine restart request. This control will be referred to as "first preset control" hereinafter.

The first preset control immediately cranks (starts) the engine EN when an engine restart request occurs. Because the motor 11 is not driven for engagement of the pinion 13 with the ring gear 50 at the occurrence of an engine restart request, it is possible to reduce the increase in power consumption due to the power supply to the motor 11 as low as possible.

In addition, the ECU 20 can carry out a second preset control described hereinafter.

Figure 2B:
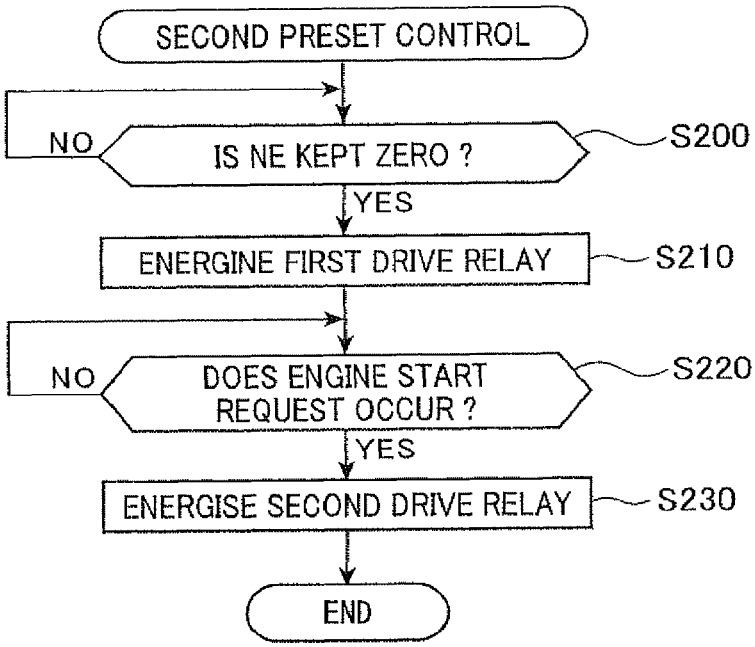
FIG. 2B is a flowchart schematically illustrating a second preset control to be executed by the ECU according to the first embodiment.

Specifically, referring to FIG. 2B, the ECU 20 determines whether the rotational speed NE of the crankshaft CS is kept zero in step S200.

When determining that the rotational speed NE of the crankshaft CS is not kept zero (NO in step S200), the ECU 20 repeats the determination in step S200.

Otherwise, when deter mining that the rotational speed NE of the crankshaft CS is kept zero (YES in step S200), the ECU 20 energizes the first drive relay 31 before the occurrence of an engine restart request in step S210. This energization of the first drive relay 31 energizes the solenoid 14 (SL1). The energization of the solenoid 14 shifts the pinion 13 to the engagement position so that the pinion 13 is engaged with the ring gear 50 prior to the occurrence of an engine restart request.

Next, the ECU 20 determines whether an engine start request occurs based on the signals outputted from the sensors 91 in step S220.

When determining that an engine restart request does not occur (NO in step S220), the ECU 20 repeats the determination in step S220.

Otherwise, when determining that an engine restart request occurs (YES in step S220), the ECU 20 energizes the second drive relay 32 to energize the motor 11, thus rotating the pinion 13 in step S230. Thereafter, the ECU 20 exits the second preset control.

Because the pinion 13 has bee meshed with the ring gear 50, the rotation of the pinion 13 cranks the engine EN.

That is, the second preset control achieves an advantage of immediately restarting (cranking) the engine EN in comparison to a control to shift the pinion 13 to the engagement position after the occurrence of an engine restart request.

Moreover, the ECU 20 can carry out a pre-rotation control described hereinafter.

Figure 2C:
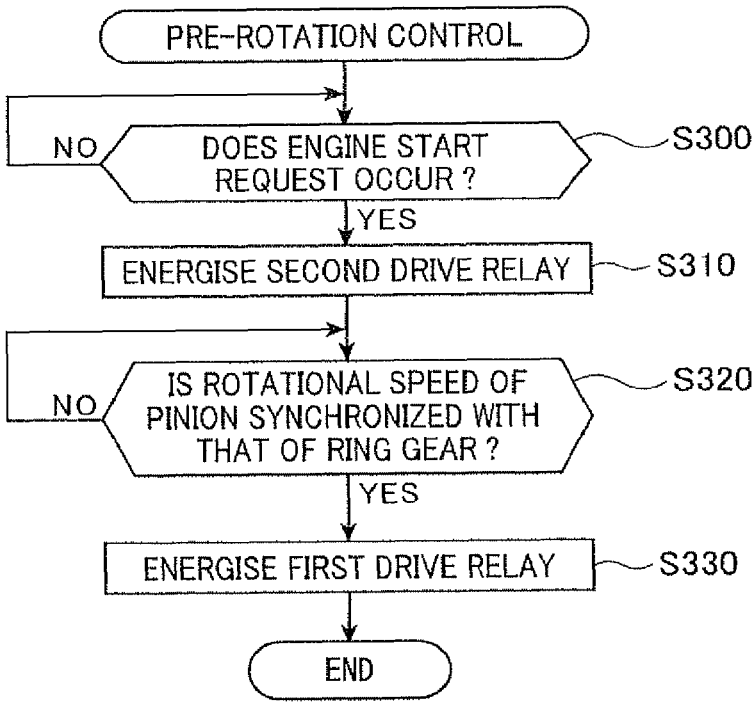
FIG. 2C is a flowchart schematically illustrating a pre-rotation control to be executed by the ECU according to the first embodiment.

Specifically, referring to FIG. 2C, the ECU 20 determines whether an engine start request occurs based on the signals outputted from the sensors 91 during the rotational speed NE of the crankshaft CS being reduced (coasting) after the automatic stop of the engine EN in step S300.

When determining that an engine restart request does not occur (NO in step S300), the ECU 20 repeats the determination in step S300.

Otherwise, when determining that an engine restart request occurs (YES in step S300), the ECU 20 energizes the second drive relay 32 to energize the motor 11, thus rotating the pinion 13 prior to the shifting of the pinion 13 in step S310.

Next, the ECU 20 determines whether the rotational speed of the pinion 13 is substantially synchronized with a rotational speed of the ring gear 50 of the crankshaft CS in step S320.

Note that, in the specification, the synchronization between the rotational speed of the pinion 13 and the rotational speed of the ring gear 50 means that the peripheral speed of the ring gear 50 (the peripheral speed of the teeth of the ring gear 50) is substantially identical to the peripheral speed of the pinion 13 (the peripheral speed of the teeth of the pinion 13).

Thus, the expression that the rotational speed of the ring gear 50 is equal to that of the pinion 13 means the fact that the peripheral speed of the ring gear 50 is equal to that of the pinion 13. Therefore, when the rotational speed of the ring gear 50 is equal to that of the pinion 13, the actual rotational speed of the ring gear 50 and that of the pinion 13 have a ratio between the diameter (for example, the diameter of a pitch circle) of the ring gear 50 and the diameter (for example, the diameter of a pitch circle) of the pinion 13.

For example, assuming that the diameter of the ring gear 50 is ten times that of the pinion 13, when the rotational speed of the ring gear 50 is synchronized with that of the pinion 13, the actual rotational speed of the pinion 13 is ten times that of the ring gear 50.

That is, when determining that the rotational speed of the pinion 13 is not substantially synchronized with the rotational speed of the ring gear 50 of the crankshaft CS (NO in step S320), the ECU 20 repeats the determination in step S320.

Otherwise, when determining that the rotational speed of the pinion 13 is substantially synchronized with the rotational speed of the ring gear 50 of the crankshaft CS (YES in step S320), the ECU 20 energizes the first drive relay 31 while the pinion 13 is rotated in step S330. This energization of the first drive relay 31 energizes the solenoid 14 (SL1). The energization of the solenoid 14 shifts the turning pinion 13 to the engagement position so that the turning pinion 13 is engaged with the turning ring gear 50. Because the rotational speed of the pinion 13 is substantially synchronized with the rotational speed of the ring gear 50 of the crankshaft CS, the engagement is smoothly carried out.

That is, the pre-rotation control achieves an advantage of immediately restarting (cranking) the engine EN in comparison to a control to engage the pinion 13 with the ring gear 50 after the rotational speed NE of the crankshaft CS is zero.

That is, the ECU 20 can carry out any one of the first preset control, the second preset control, and the pre-rotation control according to the rotational speed NE of the crankshaft CS and a relationship between the rotational speed NE of the crankshaft CS and a timing of the occurrence of an engine start request.

Note that, as described above, the crankshaft CS of the engine EN is temporarily rotated in the reverse direction immediately before the stop of the rotation of the crankshaft CS. At that time, if the ECU 20 drove the motor 11 to rotate the pinion 13 immediately after engagement of the pinion 13 with the ring gear 50, torsional stress due to the engagement and torsional stress due to the torque created by the motor 11 would be overlappedly generated. Therefore, the motor 11, the output shaft 11*a*, and the crankshaft CS would be subjected to the relatively great torsional stresses.

In contrast, the ECU 20 according to the first embodiment waits for a lapse of the first standby period P1 slightly longer than the second standby period P2; this second standby period P2 is required from the start of shifting of the pinion 13 to engagement of the pinion 13 with the ring gear 50 (see steps S130 and S150). After completion of the waiting, the ECU 20 turns on the second drive relay 32 to turn on the relay switch 12 (see step S160), thus rotating the motor 11 together with the pinion 13.

Because the torsional stress due to the engagement is generated for a moment immediately after the engagement, the waiting for the first standby period P1 allows the action of the torsional stress due to the engagement and the action of the torsional stress due to the torque created by the motor 11 to be distributed. This distribution reduces the maximum level of the torsional stresses, thus reducing fatigue of metal parts of the starter 10 subjected to the torsional stresses.

As described above, the engine starting system 1 according to the first embodiment is designed to variably determine a standby period from the start timing of shifting the pinion 13 to the engagement position to the timing of rotation of the pinion 13 according to a value of the rotational speed NE of the crankshaft CS immediately after the energization of the first drive relay 31.

That is, in order to implement the variable determination of the standby period from the start timing of shifting the pinion 13 to the engagement position to the timing of rotation of the pinion 13, the engine starting system 1 is comprised of: the first drive relay 31 for switching energization and deenergization of the solenoid 14 (the pinion-shifting actuator), the second drive relay 32, and the relay switch 12 independently from each other; these second drive relay 32 and the relay switch 12 are adapted to switch energization and deenergization of the motor 11.

In addition, the engine starting system 1 is configured to individually control the shifting of the pinion 13 and rotation thereof; this configuration enables the variable determination of the standby period from the start timing of shifting the pinion 13 to the engagement position to the timing of rotation of the pinion 13.

Specifically, it is possible to switch energization and deenergization of the motor 11 independently of the shifting of the pinion 13, and to switch energization and deenergization of the solenoid 14 independently of the drive condition of the motor 11. Thus, it is possible to control the solenoid 14 and the motor 11 such that they are completely independent from each other.

In the engine starting system 1, the relay switch 12 for switching energization and deenergization of the motor 11 and the second drive relay 32 for controlling activation of the relay switch 12 serve as a second switch unit for switching energization and deenergization of the motor 11.

If the relay switch 12 was not provided so that the second switch unit for switching energization and deenergization of the motor 11 is constructed only by the second drive relay 32, the following problem would be caused.

Specifically, because power to be supplied to the motor 11 is higher than power to be supplied to solenoid 14, as the second drive relay 32, a relay that withstands high current would be required. For this reason, because a higher energizing current would be required to maintain the on state of the second drive relay 32, the ECU 20 might not directly control the operations of the second drive relay 32.

In view of the aforementioned point, the engine starting system 1 is configured such that the relay switch 12 for switching energization and deenergization of the motor 11 and the second drive relay 32 for controlling activation of the relay switch 12 constitute the second switch unit for switching energization and deenergization of the motor 11.

This configuration reduces a current value to be supplied to the second drive relay 32 in comparison to a current value to be supplied to the relay switch 12 to the motor 11. Thus, it is possible to reduce the level of the energizing current required to maintain the on state of the second drive relay 32. This reduction allows the ECU 20 to directly control the operations of the second drive rely 32. For this reason, it is possible to control the start timing of rotation of the motor 11 at high accuracy, thus improving the controllability with respect to the second drive relay 32.

Second Embodiment

Figure 3:
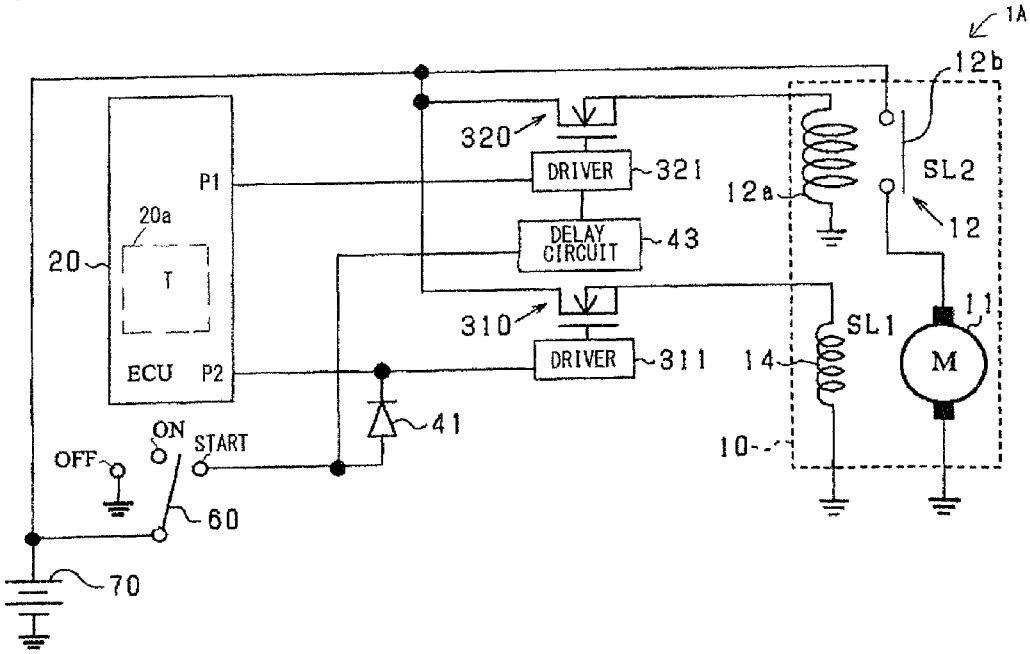
FIG. 3 is a schematic system configuration diagram of an engine starting system according to the second embodiment of the present invention.

An engine starting system 1A according to the second embodiment of the present invention will be described hereinafter with reference to FIG. 3. In FIG. 3, in order to simply illustrate the structure of the engine starting system 1A, the pinion 13, the one-way clutch 15, the plunger 14, the shift lever 17, the engine EN, the sensors 91, and the like are omitted in illustration.

The structure and/or functions of the engine starting system 1A according to the second embodiment are different from the engine starting system 1 in the following points.

Specifically, a MOS transistor relay (semiconductor relay) 310 is used, in place of the first drive relay 31, as the first switch unit for energizing and deenergizing the solenoid 14. The drain of the MOS transistor relay 310 is electrically connected to the positive terminal of the battery 70, and the source thereof is electrically connected to the solenoid 14.

A MOS transistor relay (semiconductor relay) 320 is used, in place of the second drive relay 32, as the second switch unit for switching energization and deenergization of the motor 11. The drain of the MOS transistor relay 310 is electrically connected to the positive terminal of the battery 70, and the source thereof is electrically connected to the solenoid 12*a*.

Note that, as the relay switch 12 for directly energizing and deenergizing the motor 11, a mechanical relay is used like the first embodiment.

The engine starting system 1A is further comprised of a first driver 311 and a second driver 321. The first driver 311 is electrically connected to the ECU 20, to the first diode 41, and to a control terminal, such as the gate, of the MOS transistor relay 310. The second driver 321 is electrically connected to the ECU 20, to the delay circuit 43, and to control terminal, such as the gate, of the MOS transistor relay 320.

The first driver 311 is activated according to an instruction sent from the ECU 20 or the energizing current sent from the battery 70 via the ignition switch 60 and the first diode 41. When activated, the first driver 311 is designed to control a gate current to be supplied to the gate of the MOS transistor relay 310 to thereby adjust the duty cycle of the gate signal. For example, the first driver 311 is designed to operate in PWM mode to output, as the gate current, a pulse current with the width of each pulse being modulated.

Similarly, the second driver 321 is activated according to an instruction sent from the ECU 20 or the energizing current sent from the battery 70 via the ignition switch 60 and the delay circuit 43. When activated, the second driver 321 is designed to control a gate current to be supplied to the gate of the MOS transistor relay 320 to thereby adjust the duty cycle of the gate signal. For example, the second driver 321 is designed to operate in PWM mode to output, as the gate current, a pulse current with the width of each pulse being modulated.

Note that the second diode 42 is omitted from the configuration of the engine starting system 1A.

Other elements and circuit structure of the engine starting system 1A are substantially identical to those of the engine starting system 1. That is, the engine starting system 1A is configured to control the solenoid 14 and the motor 11 such that they are completely independent from each other.

Thus, the ECU 20 of the engine starting system 1A is adapted to carry out the first preset control, the second preset control, and the pre-rotation control described in the first embodiment.

As described above, the engine starting system 1A according to the second embodiment is provided with the MOS transistor relays 310 and 320 in place of mechanical relays. Because each of the MOS transistor relays 310 and 320 has an operating time faster than that of mechanical relays, it is possible for the engine control system 1A to start shifting of the pinion 13 and rotation of the motor 11 more faster than engine control systems using mechanical relays. In addition, because the operating times of the MOS transistor relays 310 and 320 are substantially constant, there are small variations between the operating times of the MOS transistor relays 310 and 320. Thus, it is possible to control, at high accuracy, the start timing of shifting of the pinion 13 and the start timing of rotation of the motor 11.

Each of the MOS transistor relays 310 and 320 has a lower recovery time in comparison to that of mechanical relays; this recovery time means a time required for a relay in off state by deenergization to recover to on state by energization immediately after the deenergization. Thus, in automatically starting the engine EN after automatic stop thereof, it is possible to make shorter a time required from the occurrence of an engine start request to the start of the engine EN in comparison to engine starting systems using mechanical relays.

Because each of the MOS transistor relays 310 and 320 has higher durability than that of mechanical relays, it is possible to improve the durability of the engine starting system 1A in comparison to engine starting systems using mechanical relays.

Particularly, the idle reduction control (engine automatic stop and restart control) set forth above frequently turns on and off the MOS transistor relays 310 and 320. For this reason, the advantage of improving the durability of the engine starting system 1A becomes more evident.

Additionally, the ECU 20 causes the second driver 321 to control the gate current to be supplied to the gate of the MOS transistor relay 320 to thereby adjust the duty cycle of the gate signal. This allows control of the rotational speed of the motor 11 at high accuracy with the change of the rotational speed being smoothed.

Third Embodiment

Figure 4:
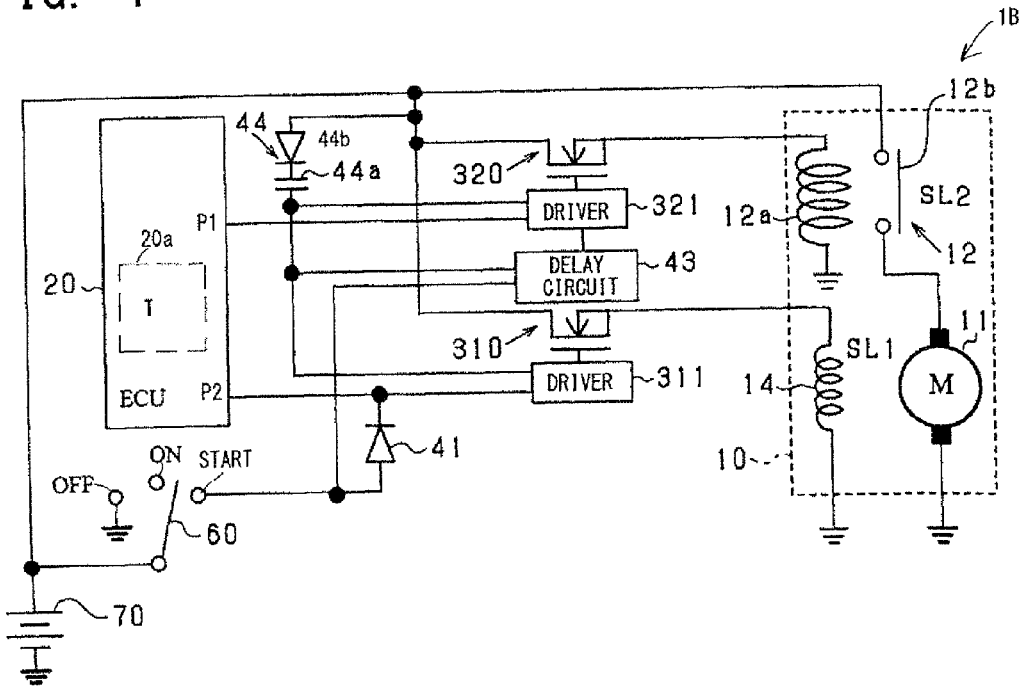
FIG. 4 is a schematic system configuration diagram of an engine starting system according to the third embodiment of the present invention.

An engine starting system 1B according to the third embodiment of the present invention will be described hereinafter with reference to FIG. 4. In FIG. 4, in order to simply illustrate the structure of the engine starting system 1B, the pinion 13, the one-way clutch 15, the plunger 14, the shift lever 17, the engine EN, the sensors 91, and the like are omitted in illustration.

The engine starting system 1A according to the second embodiment is configured to drive the drivers 311 and 321 to output the gate current (energizing current) to the MOS transistor relays 310 and 320 to thereby turn on the MOS transistor relays 310 and 320, respectively.

At that time, the level of the gate current required to keep each of the MOS transistors 310 and 320 in on state is higher than the level of the energizing current to be supplied to the solenoid of each of the mechanical relays 31 and 32.

This might not maintain each of the MOS transistors 310 and 320 in on state if the battery voltage is reduced due to inrush current caused at the time of starting the supply of power to the motor 11. Particularly, during cold start of the engine EN, the load on the motor 11 may increase with increas460e in the friction of slidably contact portions of each cylinder and the piston installed therein of the engine EN. Because this heavy load on the motor 11 may reduce the battery voltage, there may be considerable concern that each of the MOS transistors 310 and 320 might not be maintained in on state.

In view of the aforementioned circumstances, the engine starting system 1B according to the third embodiment is provided with a power supply circuit 44 in addition to the structure of the engine starting system 1A. When the battery voltage is instantly reduced to be equal to or lower than a preset level, the power supply circuit 44 is operative to supply, to the first and second drivers 311 and 321, power to be used as the gate current (energizing current) to each of the MOS transistors 310 and 320.

Specifically, the power supply circuit 44 is comprised of a capacitor 44*a* and a diode 44*b*, the anode of which is electrically connected to the positive terminal of the battery 70, the cathode of which is electrically connected to one electrode of the capacitor 44*a*. The other electrode of the capacitor 44*a* is electrically connected to the first driver 311, the second driver 321, and the delay circuit 43.

That is, the power supply circuit 44 is electrically connected in parallel to each of the MOS transistors 310 and 320. Each of the first and second drivers 311 and 321 operates on the operating voltage of 5 V supplied from the ECU 20.

Other elements and circuit structure of the engine starting system 1B are substantially identical to those of the engine starting system 1A.

In the structure of the engine starting system 1B, because the battery voltage is applied to the power supply circuit 44, the capacitor 44*a* is charged.

At that time, even if the battery voltage is reduced to be equal to or lower than the preset level due to inrush current caused at the time of starting the supply of power to the motor 11 during the on state of each of the MOS transistor relays 310 and 320 being maintained, the charged voltage in the capacitor 44*a* is applied to each of the first and second drivers 311 and 321. This continuously supplies the gate current to each of the MOS transistor relays 310 and 320 from the respective first and second drivers 311 and 321 so that the first and second MOS transistors 310 and 320 is maintained in on state.

Accordingly, the engine starting system 1B achieves an advantage of dispelling the concern that each of the MOS transistors 310 and 320 might not be maintained in on state when the battery voltage is reduced to be equal to or lower than the preset level.

Fourth Embodiment

Figure 5:
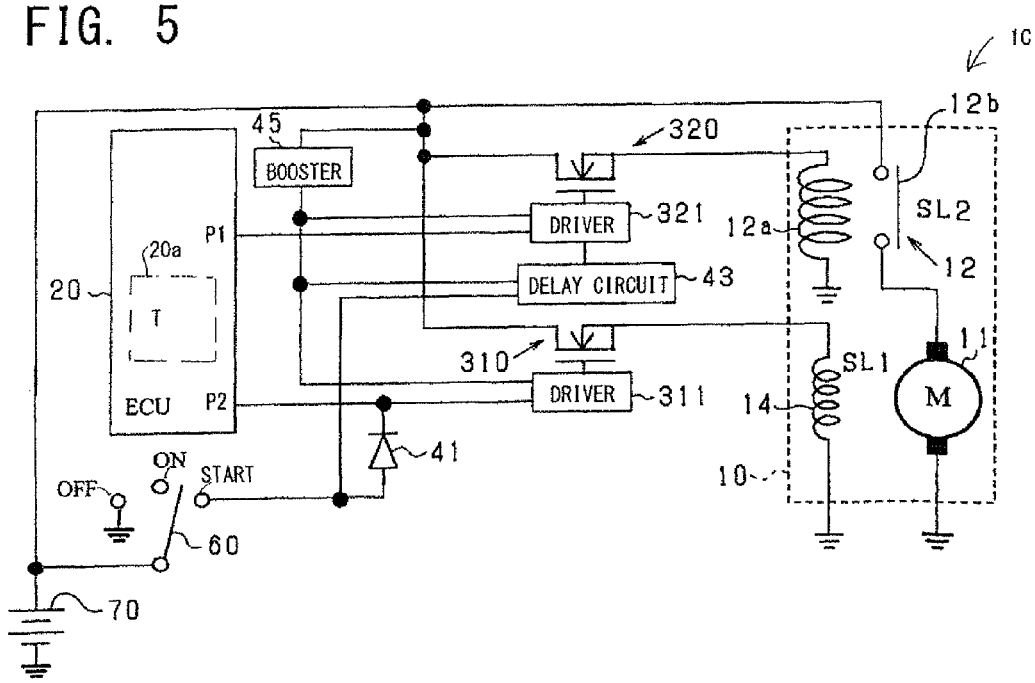
FIG. 5 is a schematic system configuration diagram of an engine starting system according to the fourth embodiment of the present invention.

An engine starting system 1C according to the fourth embodiment of the present invention will be described hereinafter with reference to FIG. 5. In FIG. 5, in order to simply illustrate the structure of the engine starting system 1C, the pinion 13, the one-way clutch 15, the plunger 14, the shift lever 17, the engine EN, the sensors 91, and the like are omitted in illustration.

In comparison to the structure of the engine starting system 1B, the engine starting system 1C according to the fourth embodiment is provided with a booster 45 in place of the power supply circuit 44.

An input terminal of the booster 45 is electrically connected to the positive terminal of the battery 70, and an output terminal thereof is electrically connected to the first driver 311, the second driver 321, and the delay circuit 43.

That is, the booster 45 is electrically connected in parallel to each of the MOS transistors 310 and 320.

Other elements and circuit structure of the engine starting system 1C are substantially identical to those of the engine starting system 1B.

In the structure of the engine starting system 1C, even if the battery voltage is reduced to be equal to or lower than the preset level due to inrush current caused at the time of starting the supply of power to the motor 11 during the on state of each of the MOS transistor relays 310 and 320 being maintained, the booster 45 boosts the battery voltage up to a sufficient high level, and applies the boosted battery voltage to each of the first and second drivers 311 and 321. This continuously supplies, even if the battery voltage is reduced to be equal to or lower than the preset level during, for example, cold start, the gate current to each of the MOS transistor relays 310 and 320 from the respective first and second drivers 311 and 321 so that the first and second MOS transistors 310 and 320 is maintained in on state.

Accordingly, the engine starting system 1C achieves an advantage of dispelling the concern that each of the MOS transistors 310 and 320 might not be maintained in on state when the battery voltage is reduced to be equal to or lower than the preset level.

Fifth Embodiment

Figure 6:
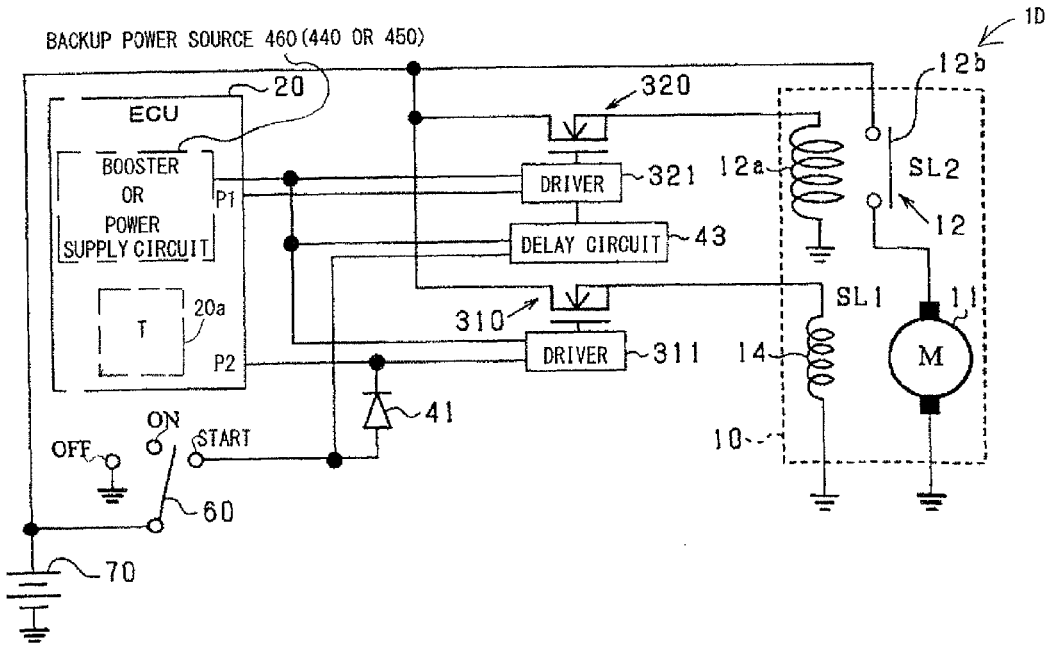
FIG. 6 is a schematic system configuration diagram of an engine starting system according to the fifth embodiment of the present invention.

An engine starting system 1D according to the fifth embodiment of the present invention will be described hereinafter with reference to FIG. 6. In FIG. 6, in order to simply illustrate the structure of the engine starting system 1D, the pinion 13, the one-way clutch 15, the plunger 14, the shift lever 17, the engine EN, the sensors 91, and the like are omitted in illustration.

The ECU 20 is normally integrated with a power supply circuit 440 or a booster 450. The power supply circuit 440 is operative to charge therein power supplied from the battery 70, and serve as a backup power source for the ECU 20 when the battery voltage is reduced to be equal to or lower than the preset level. The booster 450 is operative to, when the battery voltage is reduced to be equal to or lower than the preset level, boost the battery voltage up to a sufficient high level, and serves as a backup power source for the ECU 20.

The engine starting system 1D is designed to use, in place of the power supply circuit 44 or the booster 45, either the power supply circuit 440 functionally equivalent to the power supply circuit 44 or the booster 450 functionally equivalent to the booster 45. The power supply circuit 440 or booster 450 integrated in the ECU 20 will be referred to as a backup power source 460 hereinafter.

An input terminal of the backup power source 460 is electrically connected to the positive terminal of the battery 70, and an output terminal thereof is electrically connected to the first driver 311, the second driver 321, and the delay circuit 43.

Other elements and circuit structure of the engine starting system 1D are substantially identical to those of the engine starting system 1B or 1C.

In the structure of the engine starting system 1D, even if the battery voltage is reduced to be equal to or lower than the preset level due to inrush current caused at the time of starting the supply of power to the motor 11 during the on state of each of the MOS transistor relays 310 and 320 being maintained, the backup power source 460 continuously supplies, even if the battery voltage is reduced to be equal to or lower than the preset level during, for example, cold start, the gate current to each of the MOS transistor relays 310 and 320 from the respective first and second drivers 311 and 321 so that the first and second MOS transistors 310 and 320 is maintained in on state.

Accordingly, the engine starting system 1D achieves an advantage of dispelling the concern that each of the MOS transistors 310 and 320 might not be maintained in on state when the battery voltage is reduced to be equal to or lower than the preset level.

In addition, because the engine starting system 1D uses an originally installed backup power source 460 as the power supply circuit 440 or the booster 450 for maintaining the first and second MOS transistors 310 and 320 in on state. Thus, in comparison to the structure of each of the engine starting systems 1B or 1C, it is possible to reduce the number of components of the engine starting system 1D, thus reducing the cost of the engine starting system 1D in comparison to that of each of the engine starting systems 1B or 1C.

Sixth Embodiment

Figure 7:
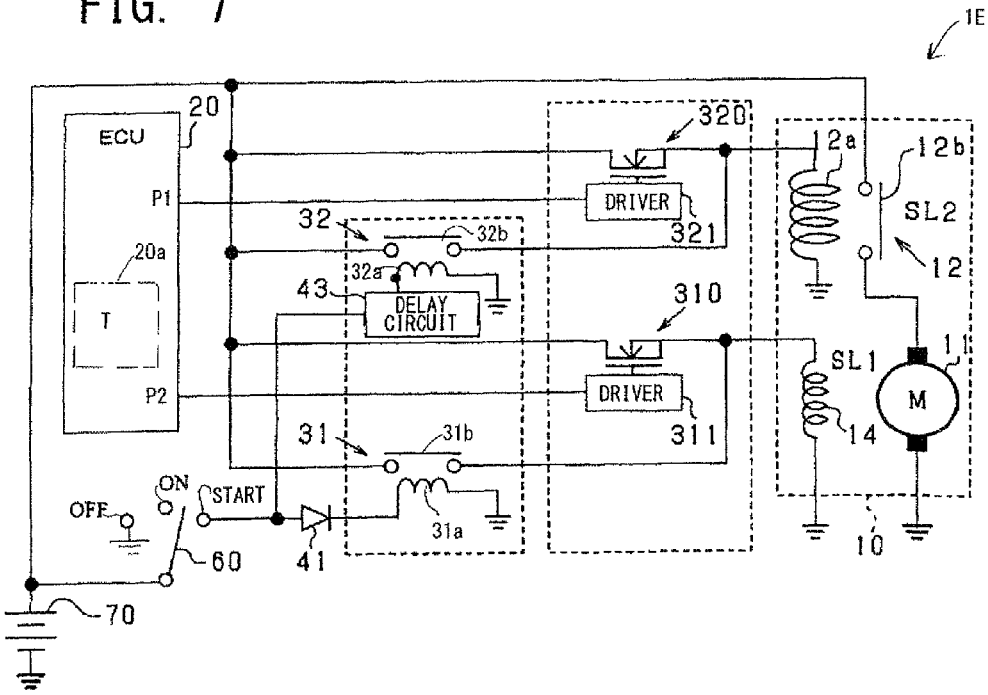
FIG. 7 is a schematic system configuration diagram of an engine starting system according to the sixth embodiment of the present invention.

An engine starting system 1E according to the sixth embodiment of the present invention will be described hereinafter with reference to FIG. 7. In FIG. 7, in order to simply illustrate the structure of the engine starting system 1E, the pinion 13, the one-way clutch 15, the plunger 14, the shift lever 17, the engine EN, the sensors 91, and the like are omitted in illustration.

In addition to the structure of the engine starting system 1, the engine starting system 1E according to the sixth embodiment is provided with the MOS transistor relays 310 and 320, and the first and second drivers 311 and 321 described in the second embodiment.

The MOS transistor relay (fourth relay) 310 is electrically connected in parallel to the first drive relay (fifth relay) 31. Specifically, the drain of the MOS transistor relay 310 is electrically connected to the positive terminal of the battery 70. The source of the MOS transistor relay 310 and one end of the switch 31 b are electrically connected to the solenoid 14, and the other end of the switch 31*b* is electrically connected to the positive terminal of the battery 70. The gate of the MOS transistor relay 310 is electrically connected to the first driver 311 that is electrically connected to the ECU 20.

The MOS transistor relay (second relay) 320 is electrically connected in parallel to the second drive relay (third relay) 32. Specifically, the drain of the MOS transistor relay 320 is electrically connected to the positive terminal of the battery 70. The source of the MOS transistor 320 and one end of the switch 32*b* are electrically connected to the solenoid 12*a*, and the other end of the switch 32*b* is electrically connected to the positive terminal of the battery 70. The gate of the MOS transistor relay 320 is electrically connected to the second driver 321 that is electrically connected to the ECU 20.

Other elements and circuit structure of the engine starting system 1E are substantially identical to those of the engine starting system 1.

As described above, the concern that each of the MOS transistors 310 and 320 might not be maintained in on state when the battery voltage is reduced to be equal to or lower than the preset level is more increased for the normal start of the engine EN in response to the driver's operation of the ignition switch 60 rather than for the automatic start of the engine EN after the automatic stop thereof.

This is because the temperature of the engine EN at the normal start of the engine EN in response to the driver's operation of the ignition switch 60 is lower than that of the engine EN at the automatic start of the engine EN after the automatic stop thereof. Specifically, during cold start of the engine EN, the load on the motor 11 may increase with increase in the friction of slidably contact portions of each cylinder and the piston installed therein of the engine EN.

Because this heavy load on the motor 11 may reduce the battery voltage, there may be considerable concern that high inrush current might be caused at the time of starting the supply of power to the motor 11 so that each of the MOS transistors 310 and 320 might not be maintained in on state.

In contrast, because the temperature of the engine EN is more increased than the temperature of the engine EN at the normal start of the engine EN in response to the driver's operation of the ignition switch 60, the load on the motor 11 due to the friction of slidably contact portions of each cylinder and the piston installed therein of the engine EN can decrease. Thus, the concern can be reduced.

In view of the circumstances set forth above, the ECU 20 according to the sixth embodiment is designed to turn on or off the first and second drive relays 31 and 32 to energize and deenergize the respective solenoid 14 and the motor 11 at the normal start of the engine EN in response to the driver's operation of the ignition switch 60. In contrast, the ECU 20 according to the sixth embodiment is designed to turn on or off the MOS transistor relays 310 and 320 to energize and deenergize the respective solenoid 14 and the motor 11 at the automatic start of the engine EN after the automatic stop thereof.

Thus, the configuration of the engine starting system 1E achieves the advantages achieved by the system 1A according to the second embodiment without dispelling the concern that each of the MOS transistors 310 and 320 might not be maintained in on state when the battery voltage is reduced to be equal to or lower than the preset level.

The configuration of the engine starting system 1E also achieves an advantage of eliminating the power supply circuit 44 and the booster 45. In other words, the configuration of each of the engine starting systems 1C and 1D according to the third and fourth embodiments achieves an advantage of eliminating the mechanical relays 31 and 32 in comparison to the configuration of the engine starting system 1E.

Seventh Embodiment

Figure 8:
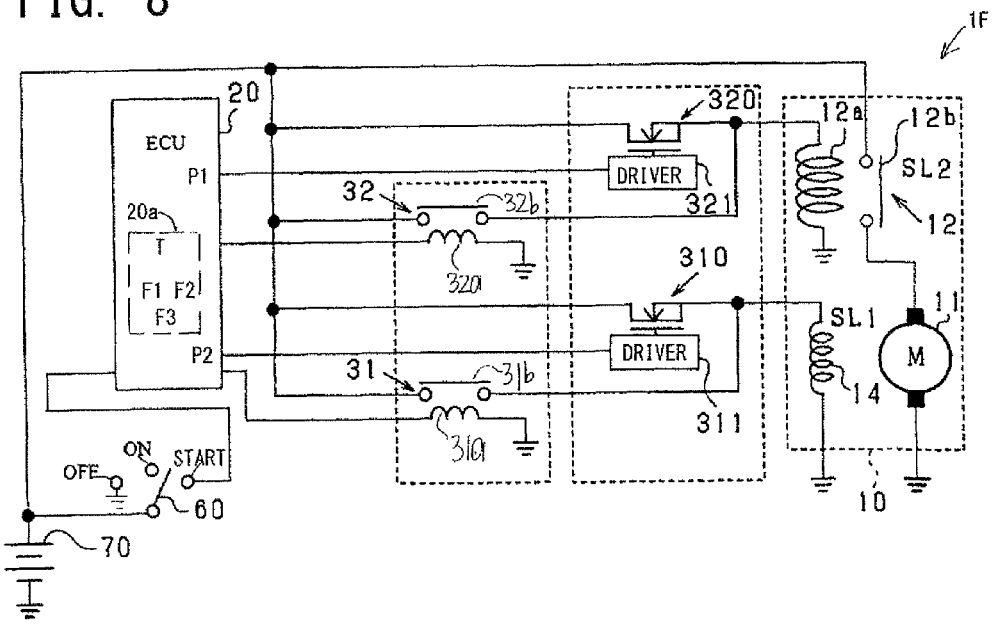
FIG. 8 is a schematic system configuration diagram of an engine starting system according to the seventh embodiment of the present invention.

An engine starting system IF according to the seventh embodiment of the present invention will be described hereinafter with reference to FIG. 8. In FIG. 8, in order to simply illustrate the structure of the engine starting system 1F, the pinion 13, the one-way clutch 15, the plunger 14, the shift lever 17, the engine EN, the sensors 91, and the like are omitted in illustration.

The ECU 20 of the engine starting system 1E according to the sixth embodiment is configured to switch between the use of the first and second drive relays 31 and 32 and the use of the MOS transistors 310 and 320 according to whether to start the engine EN in response to the driver's operation of the ignition switch 60 or to start the engine EN in response to the occurrence of an engine start request after the automatic stop of the engine EN.

In contrast, the ECU 20 of the engine starting system 1F according to the seventh embodiment is configured to switch the use of the first and second drive relays 31 and 32 and the use of the MOS transistors 310 and 320 according to the temperature of the engine EN at the start of the engine EN.

Specifically, the engine starting system 1F according to the seventh embodiment is provided with the MOS transistor relays 310 and 320, and the first and second drivers 311 and 321.

The ECU 20 is designed to selectively switch between the use of the first and second drive relays 31 and 32 and the use of the MOS transistors 310 and 320 according to the temperature of the engine EN. In order to implement the switching, the one end of each of the solenoids 31*a* and 32*a* is electrically connected to the ECU 20, and the starter-ON position START is electrically connected to the ECU 20.

Specifically, on/off for each of the first and second drive relays 31 and 32 according to the sixth embodiment is directly controlled by the driver's operation of the ignition switch 60. However, in the engine starting system 1F, the ECU 20 directly controls on/off for each of the first and second drive relays 31 and 32. Thus, the delay circuit 43 can be eliminated from the engine starting system 1F.

In the seventh embodiment, the sensors 91 include a temperature sensor operative to directly or indirectly measure at least one of: the temperature of an engine coolant; the temperature of the engine oil; and the ambient temperature outside the engine EN, and output a signal indicative of the measured temperature.

The ECU 20 has a first function F1 of calculating a value of the, temperature of the engine EN based on the signal outputted from the temperature sensor in response to any one of: the driver's operation of the ignition switch 60 to start the engine EN, and the occurrence of an engine start request after the automatic stop of the engine EN.

The ECU 20 has a second function F2 of determining whether the calculated value of the temperature of the engine EN is lower than a preset threshold temperature.

The ECU 20 has a third function F3 of:

turning on or off the first and second drive relays 31 and 32 to energize and deenergize the respective solenoid 14 and the motor 11 when it is determined that the calculated value of the temperature of the engine EN is lower than the preset threshold temperature; and turning on or off the MOS transistor relays 310 and 320 to energize and deenergize the respective solenoid 14 and the motor 11 when it is determined that the calculated value of the temperature of the engine EN is equal to or higher than the preset threshold temperature.

Specifically, for starting the engine EN with its temperature being lower than the preset threshold temperature, the load on the motor 11 may increase with increase in the friction of slidably contact portions of each cylinder and the piston installed therein of the engine EN.

Because this heavy load on the motor 11 may reduce the battery voltage, there may be considerable concern that high inrush current might be caused at the time of starting the supply of power to the motor 11 so that each of the MOS transistors 310 and 320 might not be maintained in on state.

In contrast, for starting the engine EN with its temperature being equal to or higher than the preset threshold temperature, the load on the motor 11 due to the friction of slidably contact portions of each cylinder and the piston installed therein of the engine EN can decrease. Thus, the concern can be reduced.

In view of the circumstances set forth above, the ECU 20 according to the sixth seventh embodiment is designed to turn on or off the first and second drive relays 31 and 32 to energize and deenergize the respective solenoid 14 and the motor 11 when the calculated value of the temperature of the engine EN is lower than the preset threshold temperature.

In contrast, the ECU 20 according to the seventh embodiment is designed to turn on or off the MOS transistor relays 310 and 320 to energize and deenergize the respective solenoid 14 and the motor 11 when the calculated value of the temperature of the engine EN is equal to or higher than the preset threshold temperature.

Thus, the configuration of the engine starting system 1F achieves the advantages achieved by the system 1A according to the second embodiment without dispelling the concern that each of the MOS transistors 310 and 320 might not be maintained in on state when the battery voltage is reduced to be equal to or lower than the preset level.

Note that, because the temperature of the engine EN is more increased than the temperature of the engine EN at the normal start of the engine EN in response to the driver's operation of the ignition switch 60, the ECU 20 frequently uses the first and second drive relays 31 and 32 in cases to start the engine EN in response to the driver's operation of the ignition switch 60.

Eighth Embodiment

Figure 9:
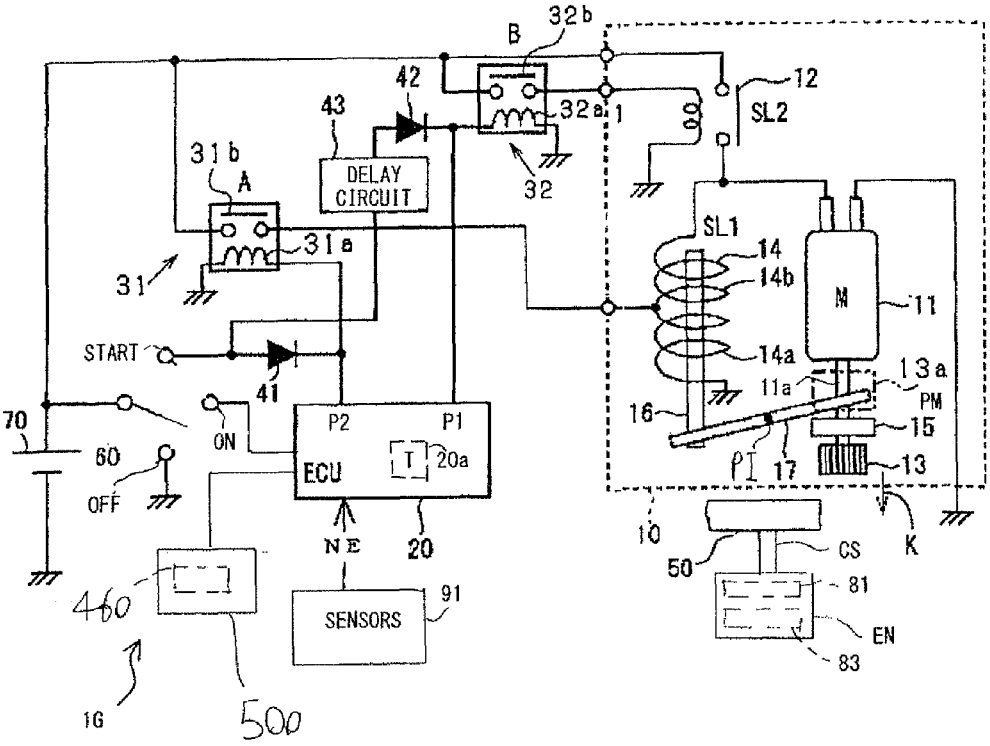
FIG. 9 is a schematic system configuration diagram of an engine starting system according to the eighth embodiment of the present invention.

An engine starting system 1G according to the eighth embodiment of the present invention will be described hereinafter with reference to FIG. 9.

In the engine starting system 1 according to the first embodiment, the switch 31*b* of the first drive relay 31 is electrically connected to the one end of the solenoid 14.

In contrast, the engine starting system 1G according to the eighth embodiment is configured such that the switch 31*b* of the first drive relay 31 is electrically connected to an inter mediate portion of the solenoid 14. Specifically, the solenoid 14 consists of a first solenoid 14*a* and a second solenoid 14*b*. One end of the solenoid 14*b* is electrically connected to one terminal of the switch 32*b*; this one terminal of the switch 32*b* is electrically connected to the high potential side of the armature of the motor 11, and the other terminal thereof is electrically connected to the positive terminal of the battery 70.

The configuration of the engine starting system 1G is based on the premise that the solenoid 14 is energized before energization of the motor 11.

Specifically, when the first drive relay 31 is turned on, the energizing current is supplied to each of the first solenoid 14*a* and the second solenoid 14*b* so that the pinion 13 is shifted from the disengagement position to the engagement position like the first embodiment. At that time, because of using the total ampere-turns of the solenoid 14, it is possible to achieve the maximum force created by the solenoid 14 to shift the pinion 13 to the engagement position.

Thereafter, when the second drive relay 32 is turned on, both ends of the second solenoid 14*b* have the same potential so that no energizing current is supplied to the second solenoid 14*b*. That is, after the pinion 13 has been shifted to the engagement position, the pinion 13 is held at the engagement position by the first solenoid 14*a*.

The engine starting system 1G according to the eighth embodiment achieves the same advantages as the engine starting system 1 according to the first embodiment.

In addition, after the second drive relay 32 has been turned on, no energizing current is supplied to the second solenoid 14*b* so that the energizing current is supplied only to the first solenoid 14*a*. Although the ampere-turns of the first solenoid 1*a* are lower than those of the solenoid 14, the ampere-turns of the first solenoid 14*a* are sufficient to hold the pinion 13 at the engagement position.

Because the ampere-turns of the first solenoid 14*a* are lower than those of the solenoid 14, the amount of heat produced by the solenoid 14 is reduced. This eliminates or reduces the need to provide measures against the produced heat. Thus, it is possible to keep compact the size of the solenoid 14.

Note that, in the engine starting system 1G according to the eighth embodiment, the delay circuit 43 located between the ignition key switch 60 and the second drive relay 32 makes energization of the solenoid 31*a* in response to the driver's operation of the ignition key switch 60 earlier than energization of the solenoid 32*a* in response to the driver's operation of the ignition key switch 60.

The present invention is not limited to the first to eighth embodiments, and therefore can be applied to various modifications of at least one of the first to eighth embodiments described hereinafter. The present invention can be applied to the combination of some of the specific features included in the first to eighth embodiments.

Figure 10:
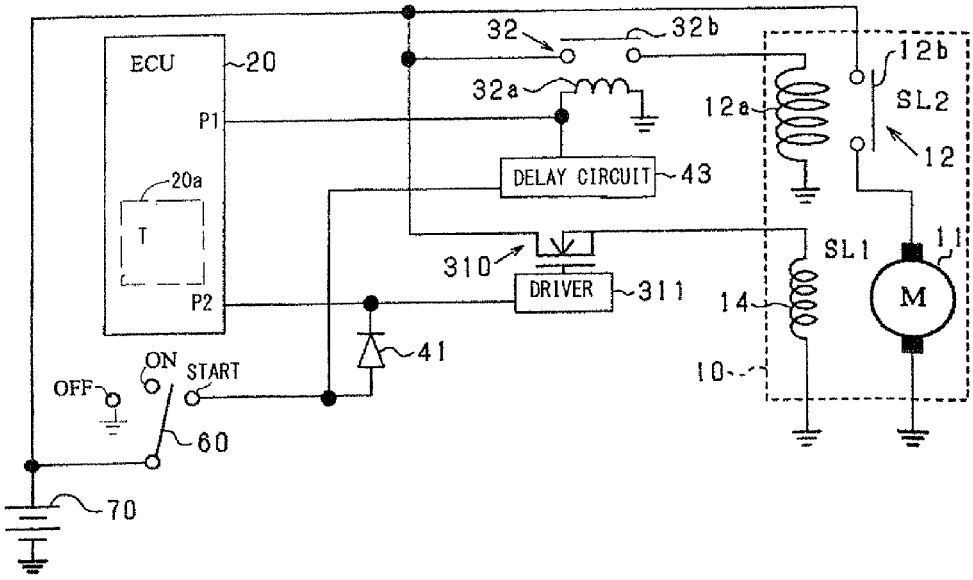
FIG. 10 is a schematic system configuration diagram of a first modification of the engine starting system according to the second embodiment of the present invention.

In the second embodiment, the semiconductor relays 310 and 320 are used as the first and second drive relays, but, as illustrated in FIG. 10, the semiconductor relay 310 is used as the first drive relay, and the mechanical relay 32 can be used in place of the semiconductor relay 320.

Figure 11:
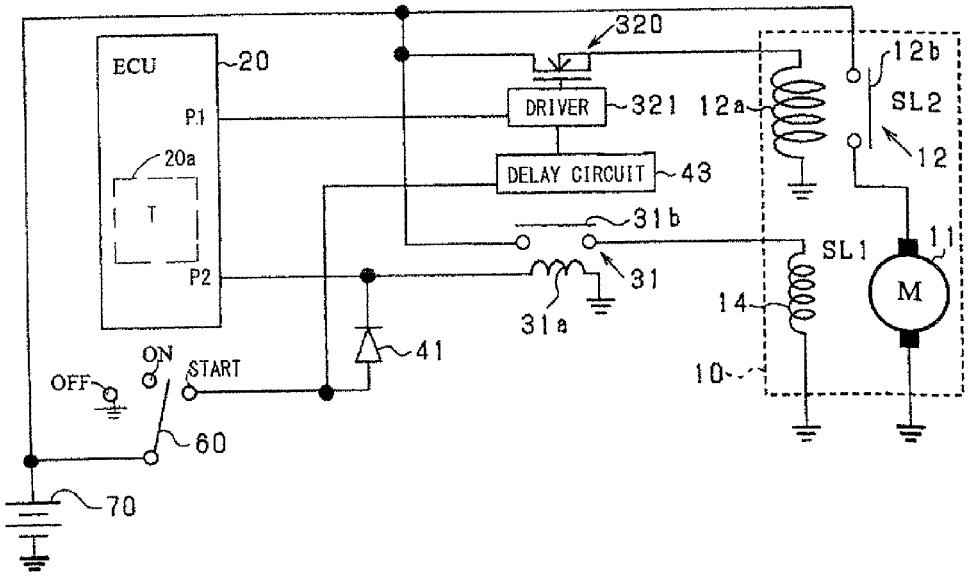
FIG. 11 is a schematic system configuration diagram of a second engine starting system according to the second embodiment of the present invention.
Figure 1:
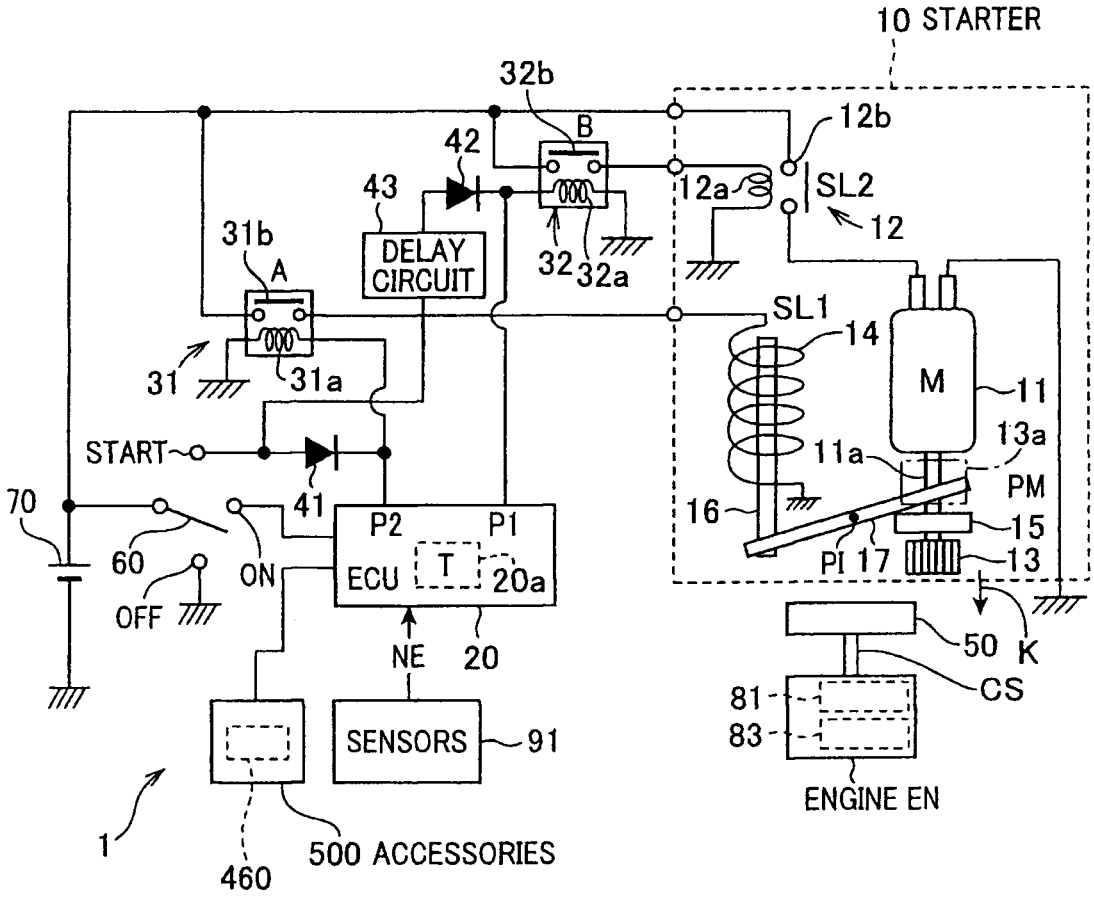
Figure 2A:
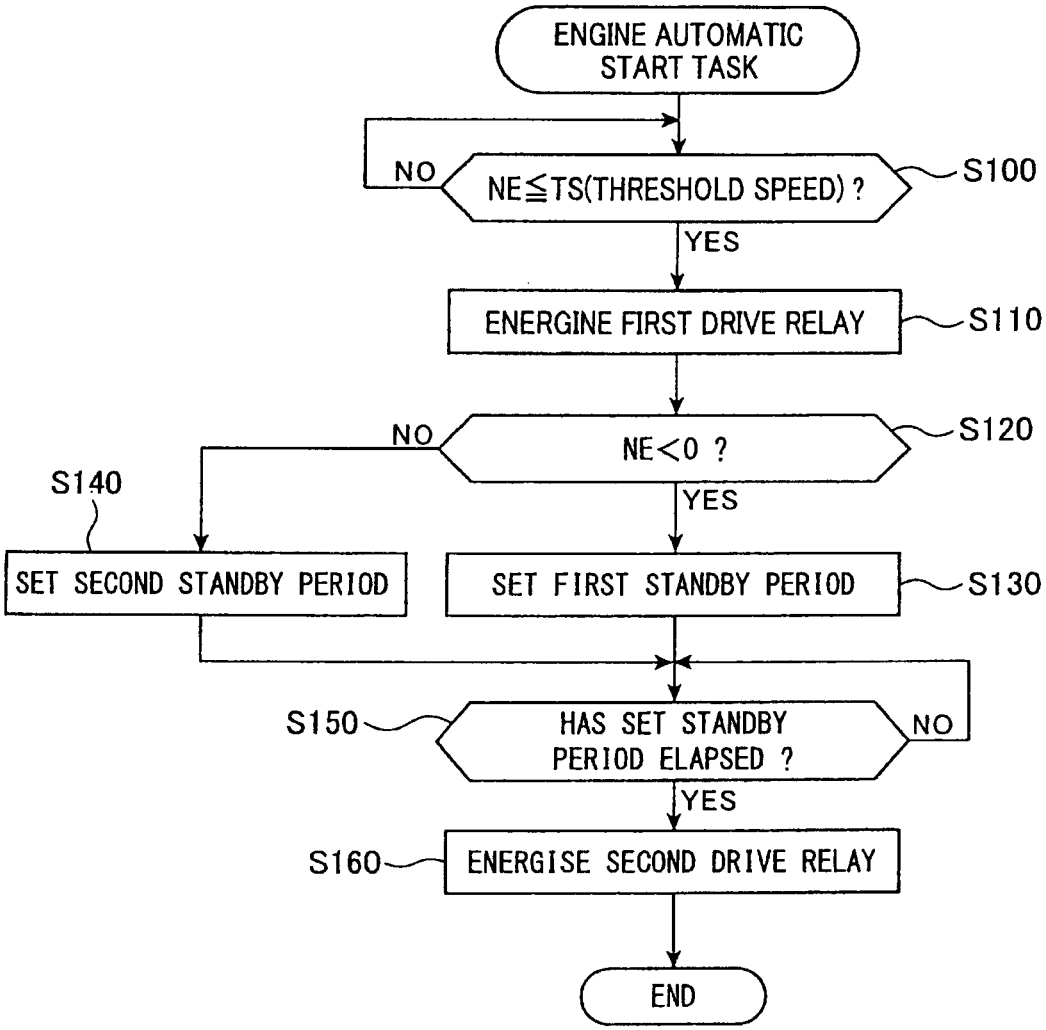
Figure 2B:
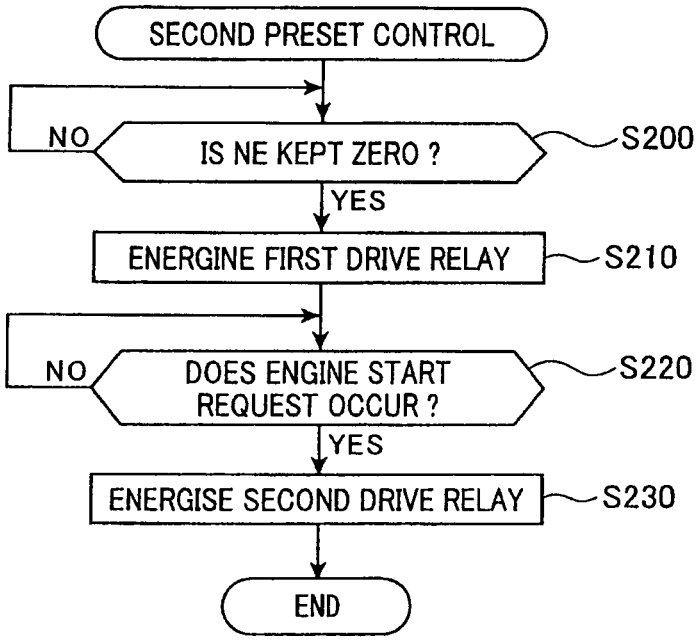
Figure 2C:
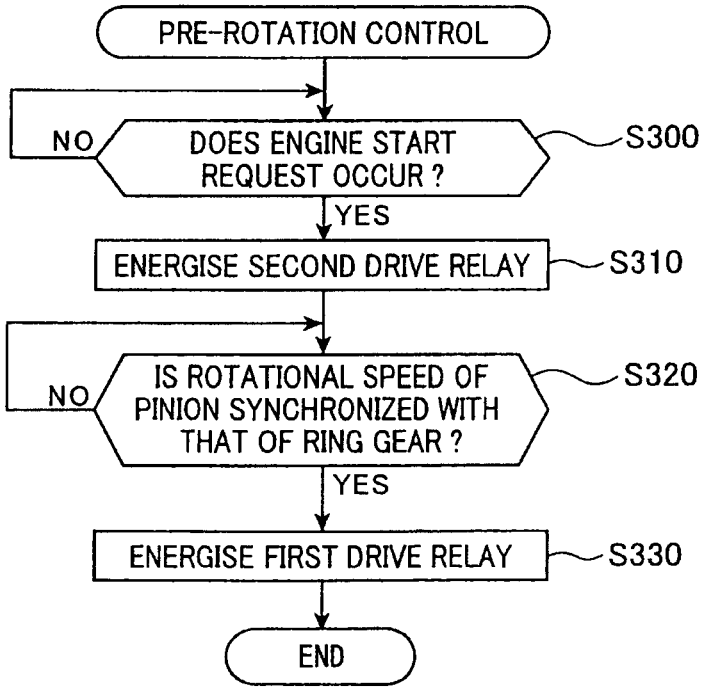
Figure 3:
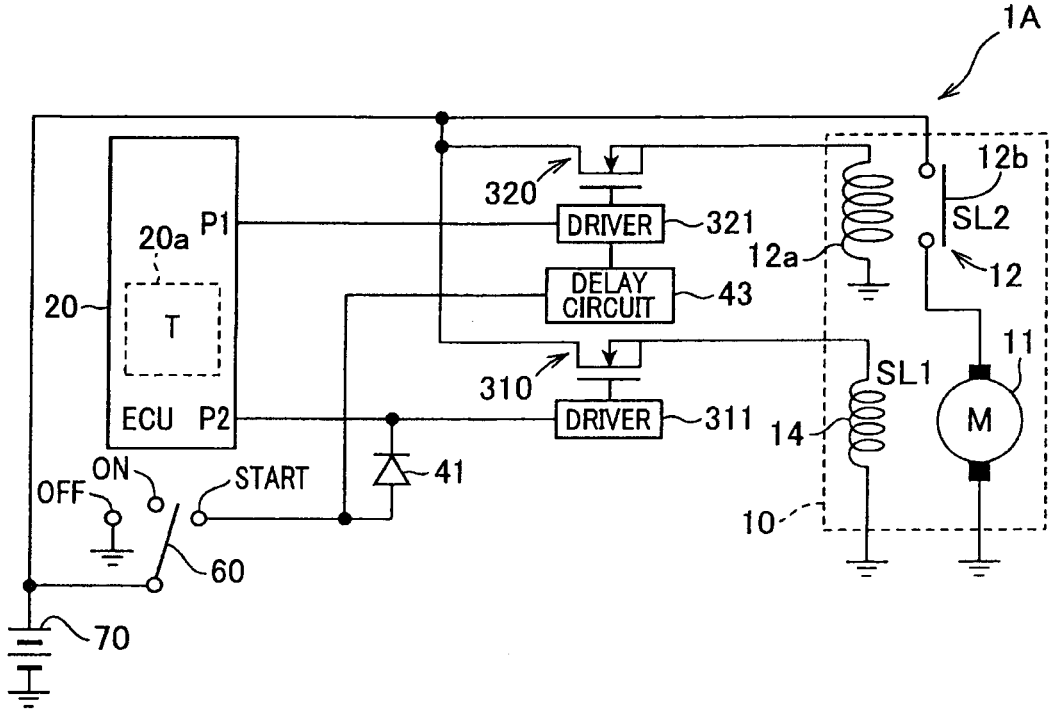
Figure 4:
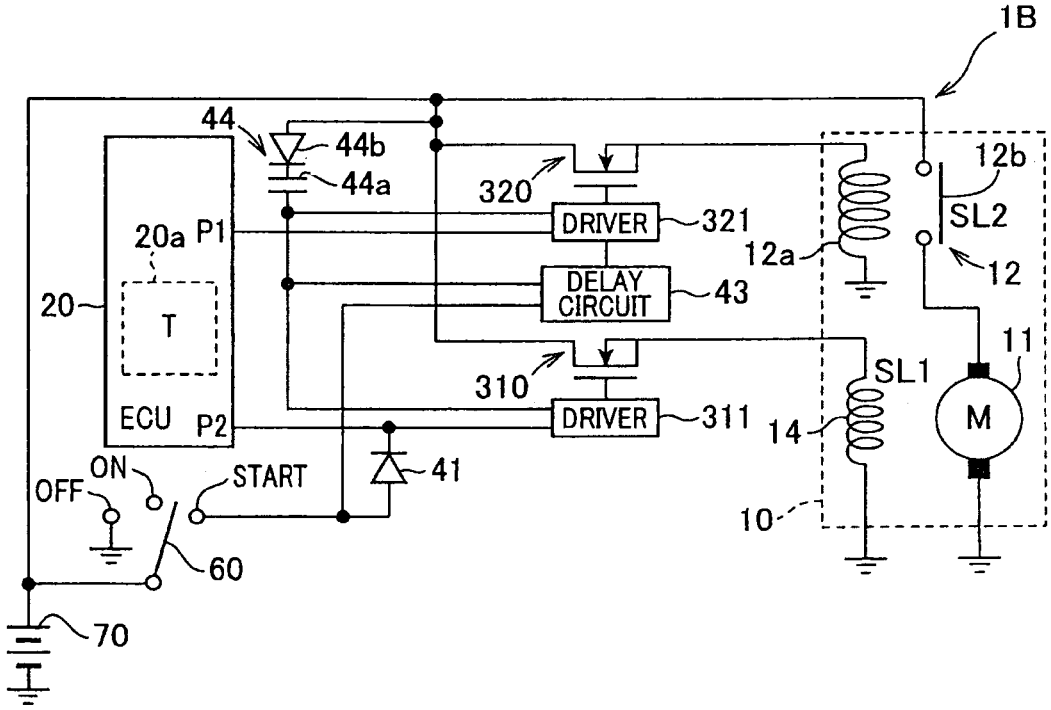
Figure 5:
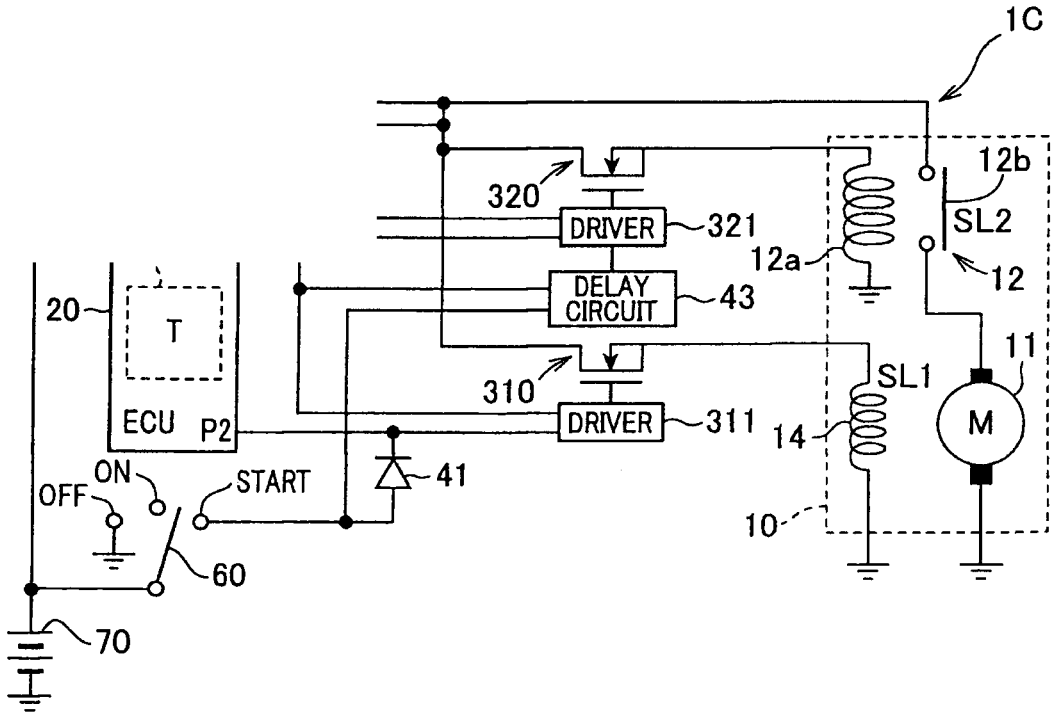
Figure 6:
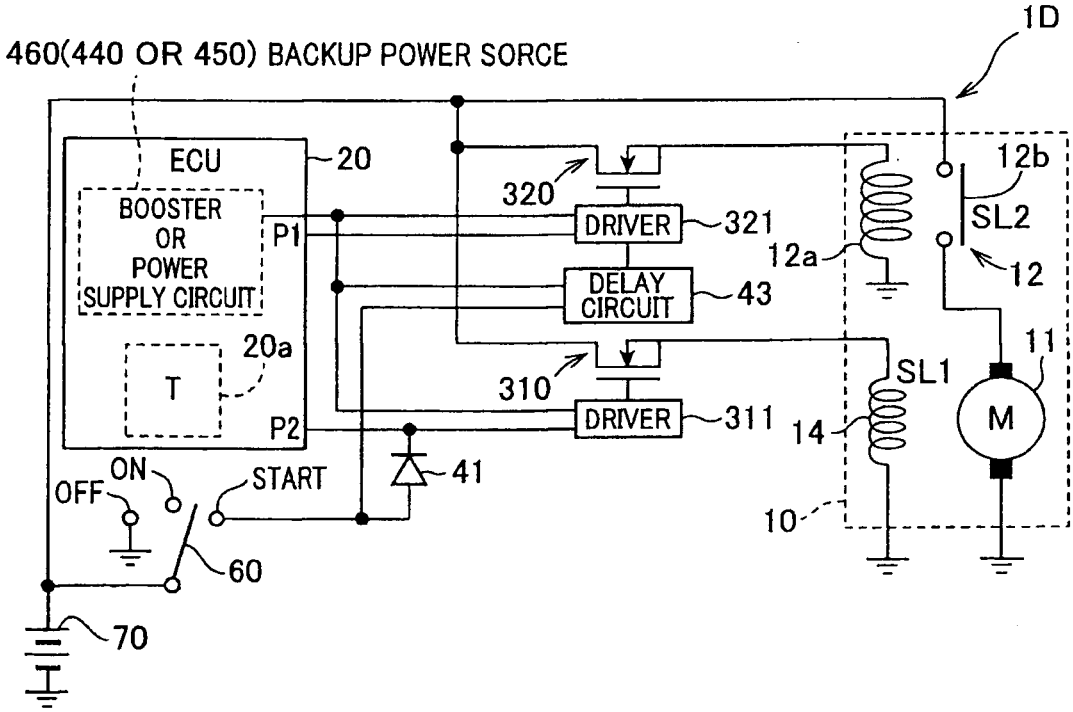
Figure 7:
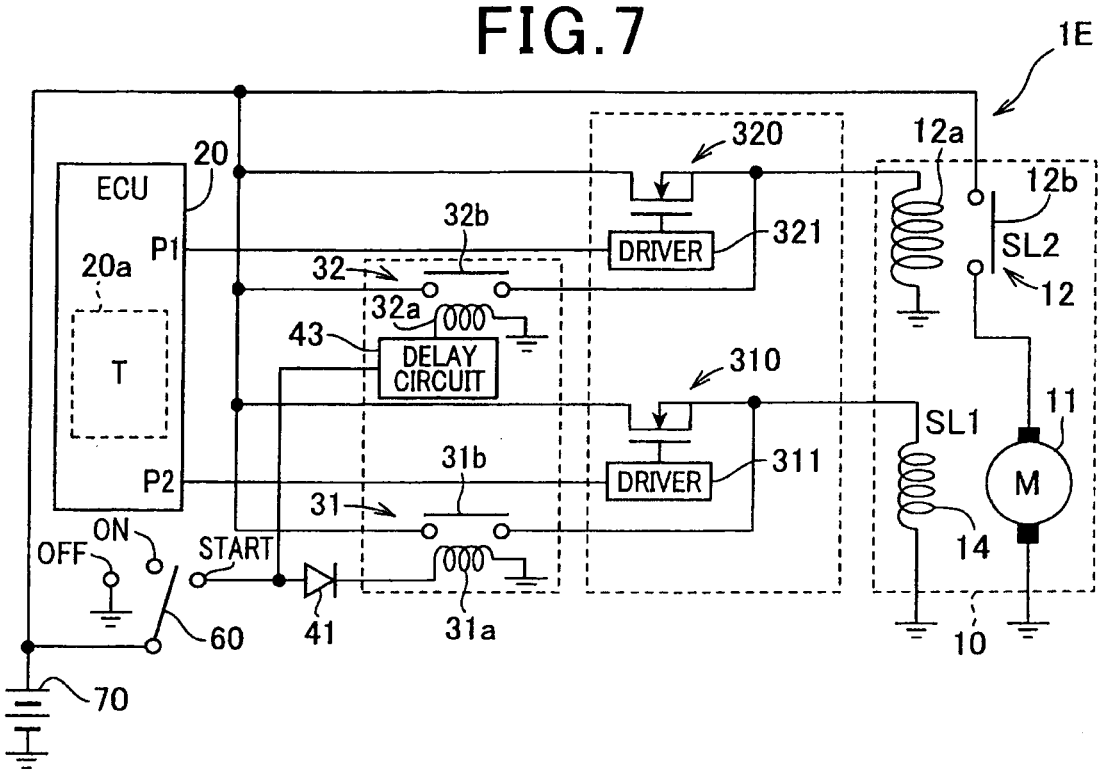
Figure 8:
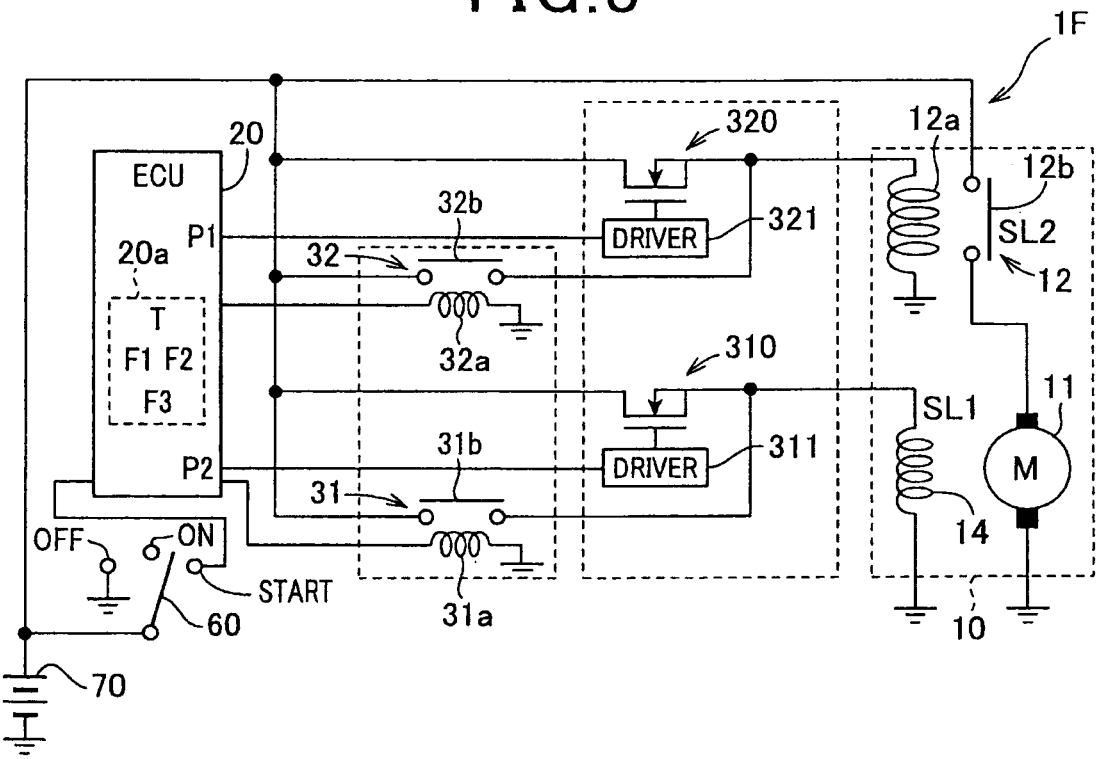
Figure 9:
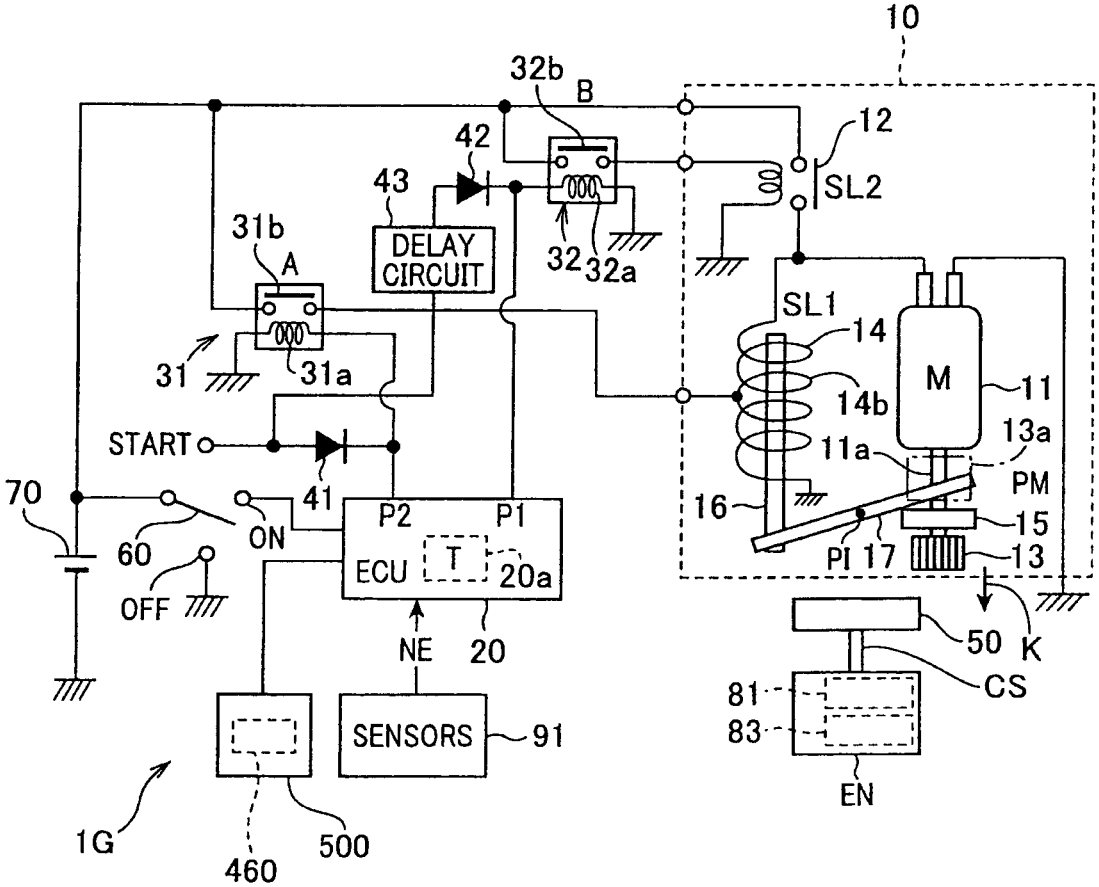
Figure 10:
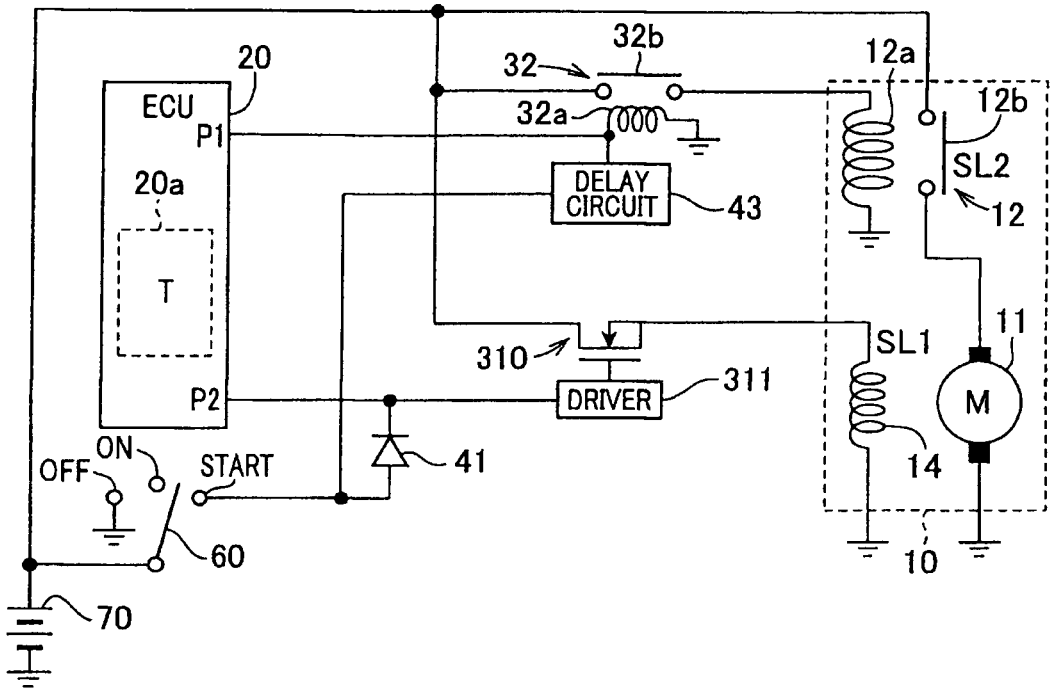
Figure 11:
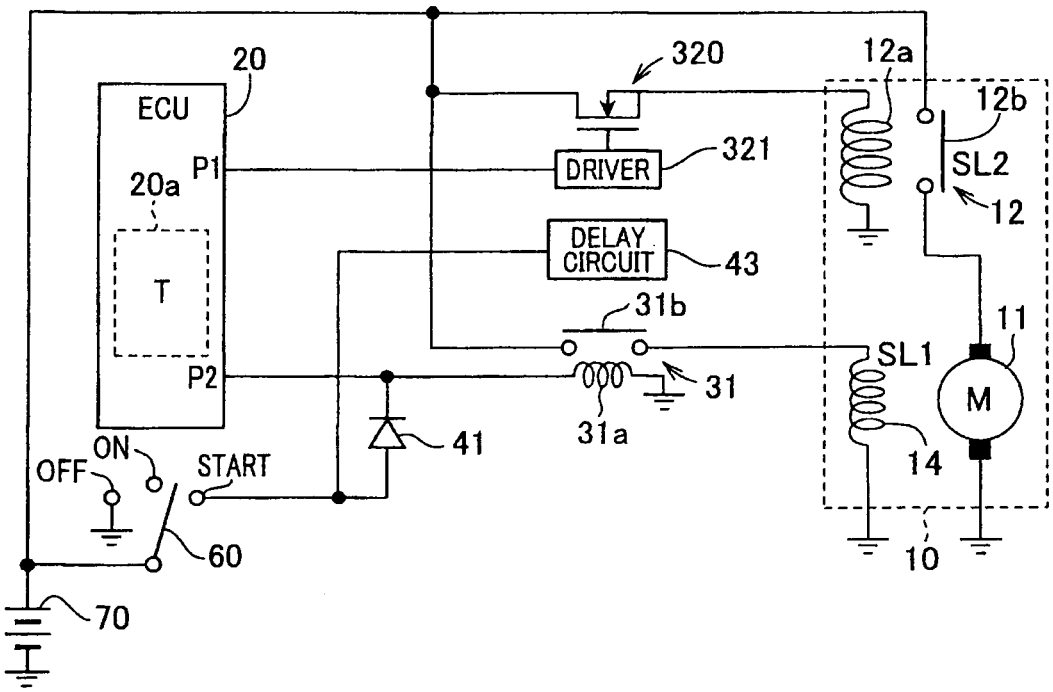

In the second embodiment, the semiconductor relays 310 and 320 are used as the first and second drive relays, but, as illustrated in FIG. 11, the mechanical relay 31 can be used in place of the semiconductor relay 310, and the semiconductor relay 320 is used as the second drive relay.

In each of the first to eighth embodiments, a mechanical relay is used as the relay switch 12, but a semiconductor relay, such as a MOS transistor relay, can be used as the relay switch 12.

If the battery voltage is reduced due to inrush current caused at the time of starting the supply of power to the motor 11, accessories 500 installed in the motor vehicle, such as a navigation system and an audio device, might be reset. Thus, at least one of the accessories 500 can be installed with the backup power source 460 for preventing the reset. Thus, it is possible to use the backup power source 460 installed in the at least one of the accessories 500 as the power supply circuit 440 or the booster 450 for maintaining the first and second MOS transistors 310 and 320 in on state.

In each of the first to eighth embodiments and their modifications, when the ignition key K inserted in the key cylinder is turned by the driver from the ignition-ON position 1G to the starter-ON position ST, the ignition key switch 60 serving as a starter switch is turned on so that an energizing current is supplied to the solenoid 31*a* and the solenoid 32*a* so as to activate the starter 10, but the present invention is not limited to the structure.

Specifically, a driver-operable starter switch, such as a push-button switch, can be provided in the motor vehicle. In this modification, when the driver-operable starter switch is operated by the driver, an energizing current is supplied from the battery 70 to the solenoid 31*a* and the solenoid 32*a* so as to activate the starter 10.

While there has been described what is at present considered to be the embodiments and their modifications of the present invention, it will be understood that various modifications which are not described yet may be made therein, and it is intended to cover in the appended claims all such modifications as fall within the scope of the invention.

What is claimed is:

1. A system for controlling a starter to start an internal combustion engine, the starter comprising:

a pinion shiftable between an engagement position and a disengagement position, the pinion being engaged with a ring gear rotatable together with a crankshaft of the internal combustion engine when located at the engagement position, the pinion being disengaged with the ring gear when located at the disengagement position;

an actuator configured to shift the pinion from the disengagement position to the engagement position when energized; and a motor configured to rotate the pinion when energized, the system comprising:

a control circuit;

a first switch unit configured to switch between energization and deenergization of the actuator under control of the control circuit; and a second switch unit configured to switch between energization and deenergization of the motor under control of the control circuit, the first switch unit and the second switch unit being individually arranged, the second switch unit comprising:

a first relay configured to switch between energization and deenergization of the motor under control of the control circuit; and a second relay configured to control activation of the first relay, the first switch unit including a third relay designed as a semiconductor relay and configured to switch between energization and deenergization of the actuator.

2. The system according to claim 1, wherein the second relay is a semiconductor relay.

3. The system according to claim 2, wherein the control circuit comprises a control unit and a driver that supplies, when driven by the control unit, an energizing signal to the second relay to thereby energize the second relay, the second relay being configured to activate the first relay so that the first relay switches to energization of the motor, the control unit operating on a battery for supplying power to the motor, further comprising:

a power supply circuit configured to charge the power supplied from the battery and to supply the charged power to the driver when a voltage of the battery is instantaneously reduced to be equal to or lower than a preset value, the driver being configured to supply the energizing signal to the second relay based on the charged power supplied from the power supply circuit.

4. The system according to claim 3, wherein the control unit is an electronic control unit containing a microcomputer, the power supply circuit is installed in the electronic control unit, the power supply circuit serving as a backup power source for the electronic control unit.

5. The system according to claim 3, wherein the control unit is an electronic control unit containing a microcomputer, the power supply circuit is installed in the electronic control unit, the power supply circuit serving as a backup power source for the electronic control unit.

6. The system according to claim 2, wherein the control circuit comprises a control unit and a driver that supplies, when driven by the control unit, an energizing signal to the second relay to thereby energize the second relay, the second relay being configured to activate the first relay so that the first relay switches to energization of the motor, the control unit operating on a battery for supplying power to the motor, further comprising:

a power supply circuit configured to boost a voltage of the battery and to supply the boosted voltage to the driver, the driver being configured to supply the energizing signal to the second relay based on the boosted voltage supplied from the booster.

7. The system according to claim 2, wherein the second switch unit comprises a fourth relay designed as a mechanical relay and connected in parallel to the second relay, the fourth relay being configured to control activation of the second relay.

8. The system according to claim 7, wherein the system is installed in a vehicle, and the control circuit is configured to:

activate the fourth relay in response to a driver's operation for starting the internal combustion engine to thereby energize the motor; and activate the second relay in response to an occurrence of an engine start request after the internal combustion engine has been automatically stopped to thereby energize the motor.

9. The system according to claim 7, further comprising a temperature output unit configured to output a signal indicative of a temperature associated with the internal combustion engine, wherein the control circuit is configured to:

determine, according to the signal outputted from the temperature output unit, whether the temperature associated with the internal combustion engine is lower than a preset value;

activate the fourth relay to thereby energize the motor when it is determined that the temperature associated with the internal combustion engine is lower than the preset value; and activate the second relay to thereby energize the motor when it is determined that the temperature associated with the internal combustion engine is equal to or higher than the preset value.

10. The system according to claim 1, wherein the control circuit is configured to:

cause the first switch unit to switch between energization and deenergization of the actuator independently of an operating state of the motor; and cause the second switch unit to switch between energization and deenergization of the actuator independently of a shift location of the pinion.

11. The system according to claim 1, wherein the first switch unit includes a fifth relay designed as a mechanical relay and connected in parallel to the third relay, the fifth relay being configured to switch between energization and deenergization of the actuator.

12. The system according to claim 11, wherein the system is installed in a vehicle, and the control circuit is configured to:

activate the fifth relay in response to a driver's operation for starting the internal combustion engine to thereby energize the actuator; and activate the third relay in response to an occurrence of an engine start request after the internal combustion engine has been automatically stopped to thereby energize the motor.

13. The system according to claim 11, further comprising a temperature output unit configured to output a signal indicative of a temperature associated with the internal combustion engine, wherein the control circuit is configured to:

determine, according to the signal outputted from the temperature output unit, whether the temperature associated with the internal combustion engine is lower than a preset value;

activate the fifth relay to thereby energize the motor when it is determined that the temperature associated with the internal combustion engine is lower than the preset value; and activate the fourth relay to thereby energize the motor when it is determined that the temperature associated with the internal combustion engine is equal to or higher than the preset value.

14. The system according to claim 1, wherein the system is installed in a vehicle, and the control circuit is configured to:

automatically stop the internal combustion engine in response to an occurrence of an engine automatic stop request; and automatically start the internal combustion engine by controlling the first and second switch units in response to an occurrence of an engine start request after the internal combustion engine has been automatically stopped.

15. The system according to claim 1, wherein the control circuit comprises:

a preset control means that controls the first switch unit to energize the actuator before energizing the motor to thereby shift the pinion to the engagement position prior to rotation of the pinion.

16. The system according to claim 15, wherein the actuator comprises a solenoid having one end and the other end, the one end is connected to a portion of the second switch unit, the portion of the second switch unit is connected to a high potential side of the motor, the actuator is configured to be subjected to power at an intermediate portion thereof, and, when the first switch unit and the second switch unit are energized, the one end of the solenoid and the intermediate portion thereof have a same potential.

17. The system according to claim 1, wherein the control circuit comprises:

a pre-rotation control means that controls the second switch unit to energize the motor to thereby rotate the pinion prior to shift of the pinion to the engagement position.

18. The system according to claim 1, wherein, after the internal combustion engine has been automatically stopped, the control circuit comprises:

a rotational speed measurement unit configured to measure a rotational speed of the crankshaft of the internal combustion engine;

a first preset control means that controls the first switch unit to energize the actuator before energizing the motor to thereby shift the pinion to the engagement position prior to rotation of the pinion;

a second preset control means that controls the first switch unit to energize the actuator before the occurrence of the engine start request to thereby shift the pinion to the engagement position prior to rotation of the pinion; and a pre-rotation control means that controls the second switch unit to energize the motor to thereby rotate the pinion prior to shift of the pinion to the engagement position, the control circuit being configured to carry out any one of the first preset control, the second preset control, and the pre-rotation control according to the rotational speed of the crankshaft of the internal combustion engine, and a relationship between the rotational speed of the crankshaft of the internal combustion engine and a timing of the occurrence of the engine start request.

* * * * *

UNITED STATES PATENT AND TRADEMARK OFFICE

CERTIFICATE OF CORRECTION

PATENT NO. : 8,428,855 B2
APPLICATION NO. : 12/782262
DATED : April 23, 2013
INVENTOR(S) : Kazushige Okumoto et al.

It is certified that error appears in the above-identified patent and that said Letters Patent is hereby corrected as shown below:

Delete the title page and substitute the attached title page therefor.

Please replace the Informal Drawing Sheets 1 to 8 (Figs. 1-11) with the attached Formal Drawing Sheets 1-8 (Figs. 1-11).

Signed and Sealed this
Twenty-sixth Day of November, 2013

Margaret A. Focarino

Margaret A. Focarino
*Commissioner for Patents of the United States Patent and Trademark Office*

(12) United States Patent
Okumoto et al.

(10) Patent No.: US 8,428,855 B2
(45) Date of Patent: Apr. 23, 2013

(54) SYSTEM FOR CONTROLLING STARTER FOR STARTING INTERNAL COMBUSTION ENGINE

(75) Inventors: Kazushige Okumoto, Kariya (JP); Akira Kato, Anjo (JP); Takashi Senda, Niwa-gun (JP)

(73) Assignee: Denso Corporation, Kariya (JP)

( * ) Notice: Subject to any disclaimer, the term of this patent is extended or adjusted under 35 U.S.C. 154(b) by 431 days.

(21) Appl. No.: 12/782,262

(22) Filed: May 18, 2010

(65) Prior Publication Data

US 2010/0299053 A1 Nov. 25, 2010

(30) Foreign Application Priority Data

May 21, 2009 (JP) ..... 2009-123207

(51) Int. Cl.
*F02N 11/08* (2006.01)

(52) U.S. Cl.
USPC ..... 701/113; 123/179.25; 123/179.28

(58) Field of Classification Search ..... 701/113; 123/179.28, 179.25
See application file for complete search history.

(56) References Cited

U.S. PATENT DOCUMENTS

| | | | | |
|---|---|---|---|---|
| 7,218,010 | B2 * | 5/2007 | Albertson et al. | 290/38 R |
| 8,079,340 | B2 * | 12/2011 | Okumoto et al. | 123/179.4 |
| 2008/0127927 | A1 | 6/2008 | Hirning et al. | |
| 2009/0020091 | A1 | 1/2009 | Botzenhard et al. | |
| 2010/0251852 | A1 * | 10/2010 | Murata et al. | 74/7 A |
| 2010/0282200 | A1 * | 11/2010 | Notani et al. | 123/179.3 |
| 2012/0104769 | A1 * | 5/2012 | Wanner | 290/38 C |

FOREIGN PATENT DOCUMENTS

| | | | |
|---|---|---|---|
| CN | 1760533 | A | 4/2006 |
| CN | 1821569 | A | 8/2006 |
| DE | 10 2009 002 721 | A1 * | 11/2010 |
| JP | A-2000-97139 | | 4/2000 |
| JP | A-2000-314364 | | 11/2000 |
| JP | A-2002-38984 | | 2/2002 |
| JP | A-2002-70699 | | 3/2002 |
| JP | A-2003-3938 | | 1/2003 |
| JP | A-2005-233081 | | 9/2005 |
| JP | A-2008-510099 | | 4/2008 |
| JP | A-2009-500550 | | 1/2009 |
| WO | WO 2007/101770 | A1 | 9/2007 |

OTHER PUBLICATIONS

Japanese Office Action issued in Japanese Patent Application No. 2009-123207 on Feb. 22, 2011 (with translation).

(Continued)

*Primary Examiner* — Hai Huynh
(74) *Attorney, Agent, or Firm* — Oliff & Berridge, PLC

(57) ABSTRACT

In a system for controlling a starter, the starter includes a pinion shiftable between an engagement position and a disengagement position. The starter includes an actuator configured to shift the pinion from the disengagement position to the engagement position when energized, and a motor configured to rotate the pinion when energized. The system includes a control circuit, a first switch unit configured to switch between energization and deenergization of the actuator under control of the control circuit, and a second switch unit configured to switch between energization and deenergization of the motor under control of the control circuit. The first switch unit and the second switch unit are individually arranged. The second switch unit includes a first relay configured to switch between energization and deenergization of the motor under control of the control circuit, and a second relay configured to control activation of the first relay.

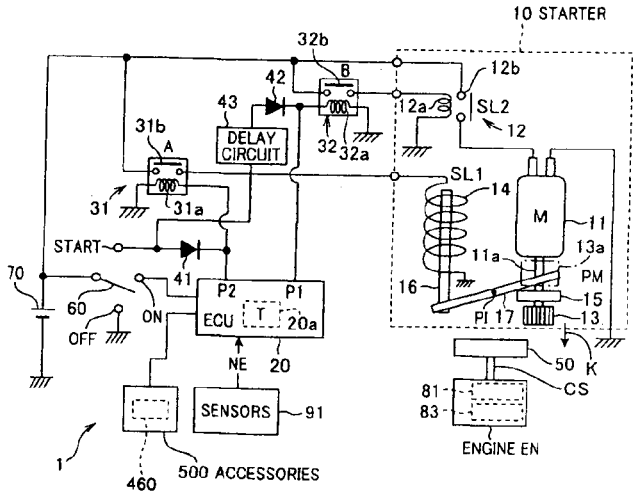

18 Claims, 8 Drawing Sheets